US011786019B2

(12) United States Patent
Cooke et al.

(10) Patent No.: US 11,786,019 B2
(45) Date of Patent: Oct. 17, 2023

(54) WRIST-WEARABLE, SELF-STANDING PERSONAL ITEM MANAGEMENT APPARATUS

(71) Applicant: THE BIG O, LLC, Dallas, TX (US)

(72) Inventors: Jane Dunne Cooke, Dallas, TX (US); Mary Caroline Nix, Dallas, TX (US)

(73) Assignee: THE BIG O, LLC, Dallas, TX (US)

( * ) Notice: Subject to any disclaimer, the term of this patent is extended or adjusted under 35 U.S.C. 154(b) by 1039 days.

(21) Appl. No.: 16/389,048

(22) Filed: Apr. 19, 2019

(65) Prior Publication Data

US 2019/0239605 A1 Aug. 8, 2019

Related U.S. Application Data

(63) Continuation-in-part of application No. 29/666,944, filed on Oct. 17, 2018, now Pat. No. Des. 848,144,
(Continued)

(51) Int. Cl.
*A45C 1/08* (2006.01)
*A45C 1/04* (2006.01)
(Continued)

(52) U.S. Cl.
CPC ..... *A45C 1/08* (2013.01); *A45C 1/02* (2013.01); *A45C 1/04* (2013.01); *A45C 11/008* (2013.01);
(Continued)

(58) Field of Classification Search
CPC ..... A45C 7/0063; A45C 7/0068; A45C 1/04; A45C 1/08; A45F 2005/008
(Continued)

(56) References Cited

U.S. PATENT DOCUMENTS

D107,719 S 12/1937 Felmann
D332,625 S 1/1993 LaPerche
(Continued)

FOREIGN PATENT DOCUMENTS

EP 1212958 A2 * 6/2002 ..... A45C 11/24

OTHER PUBLICATIONS https://www.youtube.com/watch?v=l0lSAd0flHM, posted on May 15, 2012. (Year: 2012).*
(Continued)

*Primary Examiner* — Scott T McNurlen
(74) *Attorney, Agent, or Firm* — HAYNES AND BOONE, LLP

(57) ABSTRACT

A personal item management apparatus includes a bag including opposing first and second side panels, opposing first and second end panels, and a bottom panel. In several embodiments, a first foot is formed by the bottom panel and/or the first side panel, and a second foot is formed by the bottom panel and/or the second side panel. When placed on a flat surface, the first and second feet are adapted to provide support so that the apparatus stands upright and at least a portion of the bottom panel is spaced apart from the flat surface. In several embodiments, a zipper is coupled to each of the opposing first and second side panels. A wearable band may be coupled to the zipper so that the zipper is openable and closeable by moving: the wearable band relative to the bag; and/or the bag relative to the wearable band.

1 Claim, 22 Drawing Sheets

Related U.S. Application Data and a continuation-in-part of application No. 29/632,812, filed on Jan. 10, 2018, now Pat. No. Des. 847,497, said application No. 29/666,944 is a continuation-in-part of application No. 29/632,809, filed on Jan. 10, 2018, now Pat. No. Des. 848,732, application No. 16/389,048 is a continuation-in-part of application No. 29/632,809, filed on Jan. 10, 2018, now Pat. No. Des. 848,732, said application No. 29/666,944 is a continuation-in-part of application No. 29/632,812, filed on Jan. 10, 2018, now Pat. No. Des. 847,497.

(51) Int. Cl.

| | |
|---|---|
| ***A45C 1/02*** | (2006.01) |
| ***A45C 11/00*** | (2006.01) |
| ***A45C 11/32*** | (2006.01) |
| ***A45C 11/18*** | (2006.01) |
| ***A45F 5/00*** | (2006.01) |

(52) U.S. Cl.

CPC ..... *A45C 11/18* (2013.01); *A45C 11/32* (2013.01); *A45C 11/321* (2013.01); *A45F 5/00* (2013.01); *A45F 2005/008* (2013.01); *A45F 2200/055* (2013.01); *A45F 2200/0508* (2013.01); *A45F 2200/0516* (2013.01); *A45F 2200/0525* (2013.01); *A45F 2200/0558* (2013.01)

(58) Field of Classification Search

USPC ..... D3/232, 245–246

See application file for complete search history.

(56) References Cited

U.S. PATENT DOCUMENTS

| | | | | | |
|---|---|---|---|---|---|
| D406,457 | S | * | 3/1999 | De Baschmakoff | D3/246 |
| D516,805 | S | * | 3/2006 | Suppancig | D3/246 |
| D553,850 | S | | 10/2007 | Trower | |
| D588,359 | S | | 3/2009 | Gonzalez | |
| D607,636 | S | | 1/2010 | Chiu | |
| D621,610 | S | | 8/2010 | Parsley | |
| D655,498 | S | * | 3/2012 | Sassi | D3/232 |
| D680,737 | S | * | 4/2013 | Shakouri | D3/245 |
| D693,117 | S | | 11/2013 | Maier | |
| D714,048 | S | * | 9/2014 | Wang | D3/232 |
| D742,635 | S | | 11/2015 | Coleman | |
| D758,069 | S | * | 6/2016 | Dumas | D3/232 |
| D772,563 | S | * | 11/2016 | Carol-Libman | D3/232 |
| D782,822 | S | | 4/2017 | Serrano | |
| D811,732 | S | | 3/2018 | Barclay et al. | |
| D811,733 | S | | 3/2018 | Barclay et al. | |
| D826,550 | S | | 8/2018 | Filakousky | |
| D847,497 | S | | 5/2019 | Cooke et al. | |
| D848,144 | S | | 5/2019 | Cooke et al. | |
| D848,732 | S | | 5/2019 | Nix et al. | |
| 2005/0016647 | A1 | * | 1/2005 | Carey | A45C 1/08 206/320 |
| 2008/0223892 | A1 | * | 9/2008 | Hamilton | A45F 5/00 224/267 |
| 2009/0199939 | A1 | * | 8/2009 | Pruzhansky | A45C 1/04 224/235 |
| 2019/0059538 | A1 | * | 2/2019 | Osnowitz | A45C 13/103 |

OTHER PUBLICATIONS

USPTO, Notice of Allowance dated Dec. 27, 2018 in U.S. Appl. No. 29/632,812 (13 pages).

USPTO, Notice of Allowance dated Dec. 28, 2018 in U.S. Appl. No. 29/632,809 (13 pages).

USPTO, Notice of Allowance dated Dec. 28, 2018 in U.S. Appl. No. 29/666,944 (13 pages).

USPTO, Notice of Allowance dated Sep. 11, 2019 in U.S. Appl. No. 29/697,824 (15 pages).

* cited by examiner

WRIST-WEARABLE, SELF-STANDING PERSONAL ITEM MANAGEMENT APPARATUS

CROSS-REFERENCE TO RELATED APPLICATIONS

This application is a continuation-in-part of U.S. patent application Ser. No. 29/632,809, filed Jan. 10, 2018, the entire disclosure of which is hereby incorporated herein by reference.

This application is also a continuation-in-part of U.S. patent application Ser. No. 29/632,812, filed Jan. 10, 2018, the entire disclosure of which is hereby incorporated herein by reference.

This application is also a continuation-in-part of U.S. patent application Ser. No. 29/666,944, filed Oct. 17, 2018, the entire disclosure of which is hereby incorporated herein by reference. U.S. patent application Ser. No. 29/666,944 is a continuation-in-part of each of U.S. patent application Ser. Nos. 29/632,809 and 29/632,812, the entire disclosures of which are hereby incorporated herein by reference.

Each of U.S. patent application Ser. Nos. 29/632,809, 29/632,812, and 29/666,944 incorporates by reference the entire disclosure of U.S. Patent Application No. 62/615,611, filed Jan. 10, 2018, the entire disclosure of which is hereby incorporated herein by reference.

This application is related to U.S. Patent Application No. 62/615,611, filed Jan. 10, 2018, the entire disclosure of which is hereby incorporated herein by reference.

BACKGROUND

Individuals often carry a number of personal items with them as they go about their day. Such personal items include, for example, keys, a key fob, a coin purse, a credit card case, a bottle of sanitizer, a framed photograph, and so on. As technology advances and portable electronic devices get smaller and smaller, the personal items may also include mobile or smartphones. Some of these personal items may include their own customized case, such as glasses, sunglasses, and so on.

In order to transport and temporarily store all of these person items, an individual may rely on a purse, a handbag, a backpack, or the like. Unfortunately, when the purse or handbag is placed on a surface such as a table or floor, a large surface area of the purse or handbag contacts the table or floor. Moreover, the purse and handbag often falls over on its side, spilling and/or rearranging the contents. Additionally, while some purses have a wrist-band through which the user can place his or her wrist, the wrist-bands are generally soft and flexible. Thus, the wrist-band often collapses when not being used and must be "opened" prior to the user placing his or her wrist through the wrist-band and carrying the purse. This adds time and often frustration when a user tries to carry his or her purse.

The present disclosure is directed to an apparatus, such as a wrist-wearable, self-standing personal item management apparatus, that overcomes one or more of the shortcomings in the prior art.

DETAILED DESCRIPTION

Figure 1:
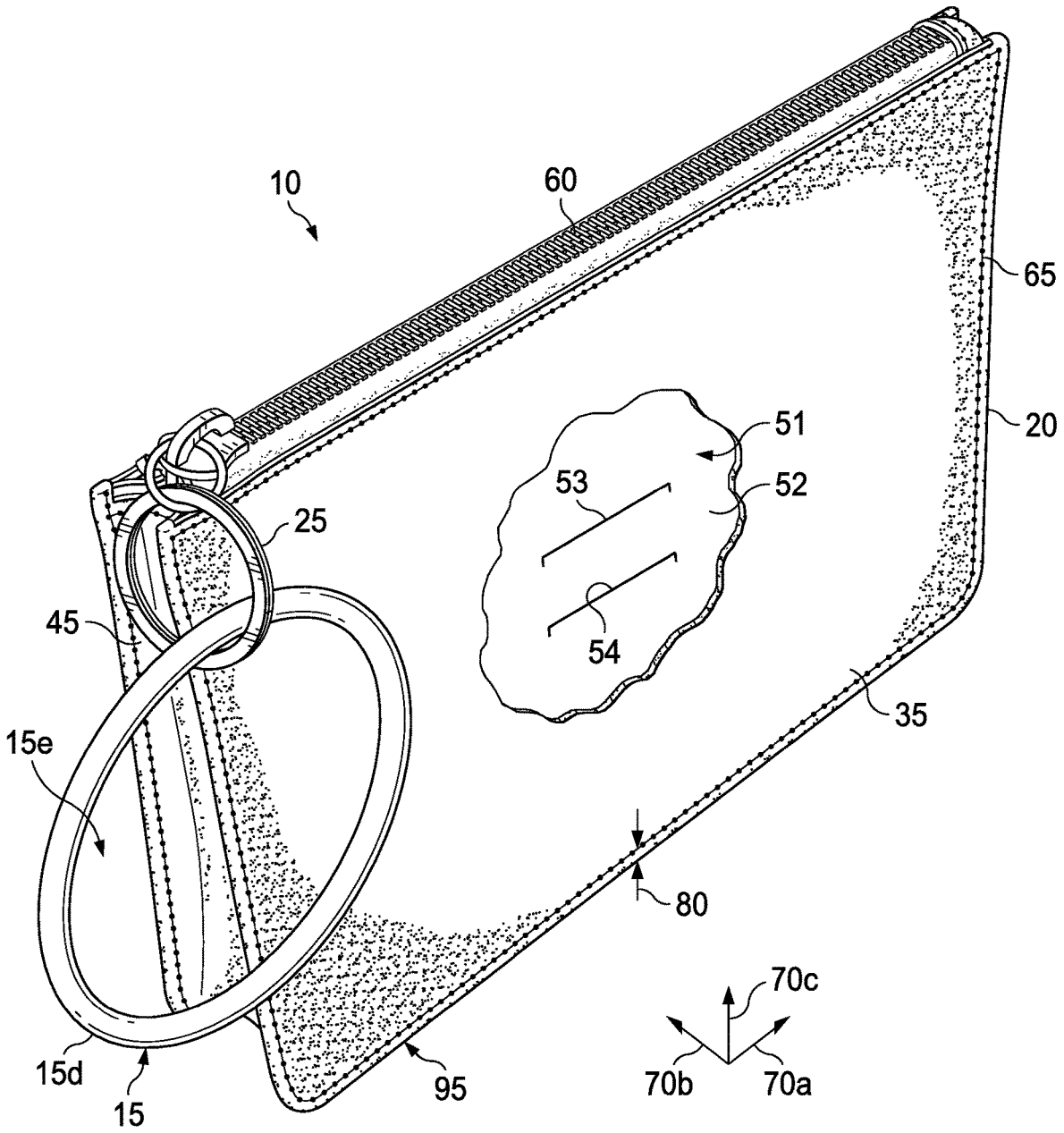
FIG. 1 is a perspective view of a personal item management apparatus, according to one or more embodiments.

The following disclosure provides many different embodiments and specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Referring to FIG. 1, in an embodiment, a personal item management apparatus is generally referred to by the reference numeral 10 and includes a ring, or wearable band 15, a bag 20, and a clasp 25 coupled to the band 15 and the bag 20. As will be more fully explained below, the apparatus 10 aims to give individuals a comfortable, hands-free way to stay organized and carry their personal items in a bag. The apparatus 10 is self-standing, which permits the bag 20 to be stored in an upright position to enable greater access to personal items in the bag 20 and reduces the surface area of the bag 20 that contacts a surface, such as a table or a floor, when the bag is placed thereon.

Figure 2A:
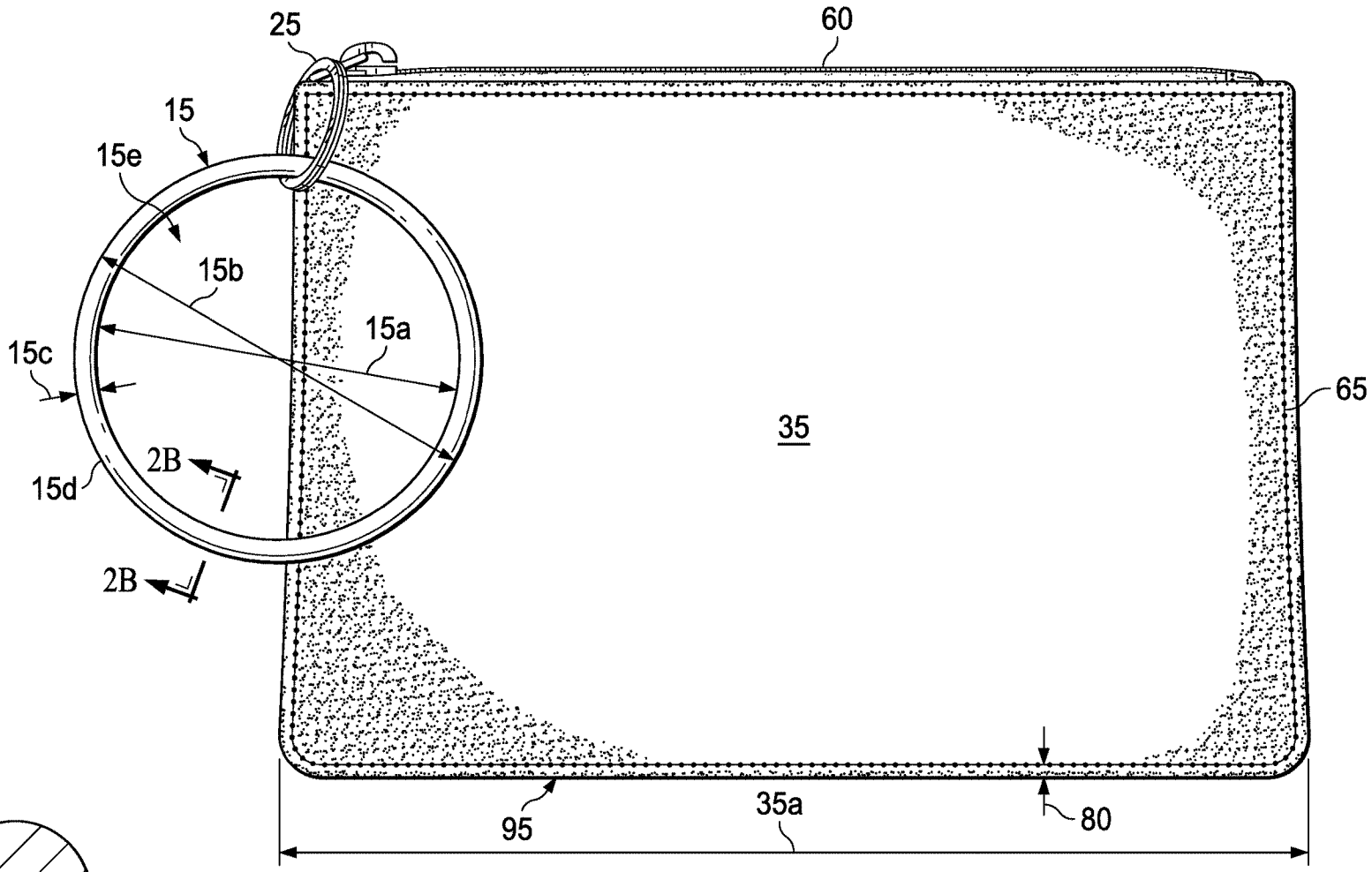
FIG. 2A is a front elevational view of the personal item management apparatus of FIG. 1, according to one or more embodiments.
Figure 2B:
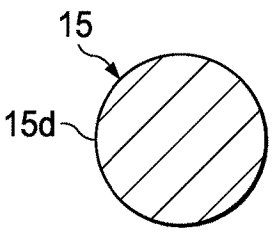
FIG. 2B is a cross sectional view of the personal item management apparatus taken along the line 2B-2B of FIG. 2A, according to one or more embodiments.

Referring to FIGS. 2A and 2B, the band 15 may be a continuous and uninterrupted ring. As shown in FIG. 2A, the band 15 has an inner diameter 15*a* and an outer diameter 15*b*. In several embodiments, the inner diameter 15*a* is about (i.e., within +/−10%) 7.6 cm and the outer diameter 15*b* is about 8.4 cm. In several embodiments, the inner diameter 15*a* is between about 8 cm and about 6 cm and the outer diameter 15*b* is about 10 cm and about 7 cm. The band 15 generally has a thickness 15*c* of about 0.4 cm but the thickness 15*c* can be anywhere between about 0.25 cm and about 1.25 cm. Generally, an exterior surface 15*d* of the band 15 is a smooth surface but in several embodiments the exterior surface 15*d* is or includes a textured surface or a patterned surface.

As shown in FIG. 2B, in several embodiments, the band 15 has a solid, circular cross section. In addition, or instead, the cross section of the band 15, or a portion thereof, may form any other shape (e.g., a square, an oval, etc.). Moreover, in several embodiments, rather than having a solid cross section, the band 15 may have a hollow interior. In an embodiment, the band 15 may be formed from waterproof or water-resistant materials or appropriately treated to impart these qualities. In an embodiment, the band 15 has a fixed circumference that defines the inner and outer diameters 15*a* and 15*b*, respectively. As such, the wearable band 15 is always positioned such that a user may insert his or her hand through an opening 15*e* defined by the inner diameter 15*a*. That is, the band 15 does not collapse into a flat-loop-like shape, but instead retains its shape. In several embodiments, the band 15 is circular. In several embodiments, the band 15 is rigid or semirigid.

In an embodiment, the band 15 is sized and dimensioned to slide over the wrist of a wearer; as a result, the band 15 may be worn like a bracelet. In an embodiment, the band 15 is sized and dimensioned to fit snugly, but comfortably, around the arm of a wearer; as a result, the band 15 may be worn like an armband. By way of example, the band 15 may be temporarily secured around the bicep or forearm of a wearer. In an embodiment, the band 15 is sized and dimensioned so that the band 15 is unable to slide beyond the forearm or elbow of the wearer. In several embodiments, rather than being a continuous and uninterrupted ring, the band 15 is not a continuous and uninterrupted ring but instead has a break or space along its circumference such that the band 15 forms a "C" shape with a gap (e.g., of less than about 0.5 cm) between the opposing end portions.

Figure 7:
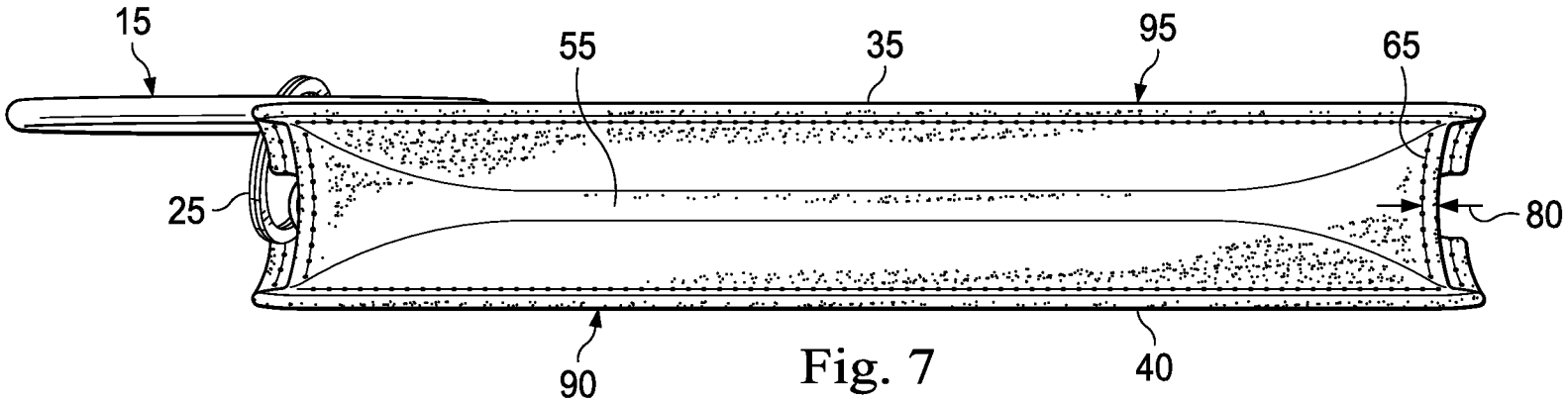
FIG. 7 is a bottom plan view of the personal item management apparatus of FIG. 1, according to one or more embodiments.
Figure 8:
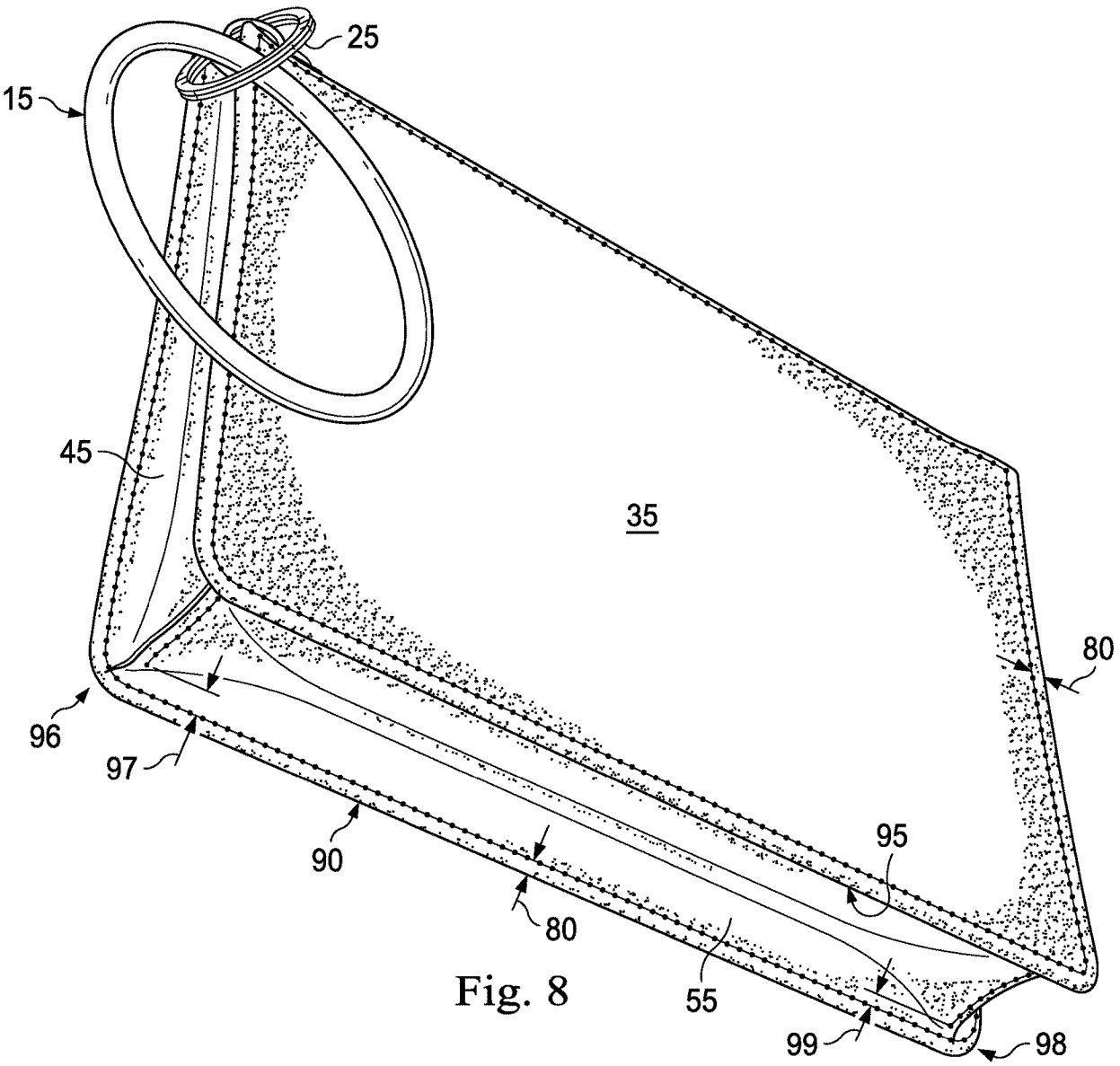
FIG. 8 is another perspective view of the personal item management apparatus of FIG. 1, according to one or more embodiments.

Referring to FIGS. 1, 2A, and 3-9, in an embodiment, the bag 20 includes opposing side panels 35 (shown in FIGS. 1, 2A, and 4-9) and 40 (shown in FIGS. 3-7 and 9), opposing end panels 45 (shown in FIGS. 1 and 5-8) and 50 (shown in FIGS. 4 and 6-9) each coupled to the side panels 35 and 40, and a bottom panel 55 (shown in FIGS. 4, 5, and 7-9) coupled to each of the side panels 35 and 40 and to each of the end panels 45 and 50. As shown in FIG. 1, the bag 20 forms an interior region 51 having an interior surface 52, with pockets 53 and 54 connected to the interior surface 52. The bag 20 also includes a zipper 60 (shown in FIGS. 1, 2A, 3-6 and 9) that is coupled to each of the side panels 35 and 40. Generally, the side panels 35 and 40, the end panels 45 and 50, the bottom panel 55, and the zipper 60 are coupled via stitching 65. As shown in FIGS. 1, 7, and 8, a seam allowance 80 is defined between the stitching 65 and the nearest edge. In several embodiments, the seam allowance 80 has a dimension of between about 0.1 cm and about 0.4 cm. Moreover, along some, most, or all, of the raw edges adjacent the stitching 65, a lining, edging, or piping extends over and/or between the two edges. In several embodiments, the bag 20 has: a length (measured along an axis identified by reference numeral 70*a* in FIG. 1) of about 21.4 cm; a lower width (measured along an axis identified by reference numeral 70*b* in FIG. 1) of about 3.5 cm; an upper width (measured along an axis identified by the reference numeral 70*b* in FIG. 1) of about 1.5 cm; and a height (measured along an axis identified by reference numeral 70*c* in FIG. 1) of about 14.9 cm. In several embodiments, the ratio of the outer diameter 15*b* of the band 15 to the height of the bag 20 is 0.56 but may be anywhere between about 1 and about 0.25.

Figure 3:
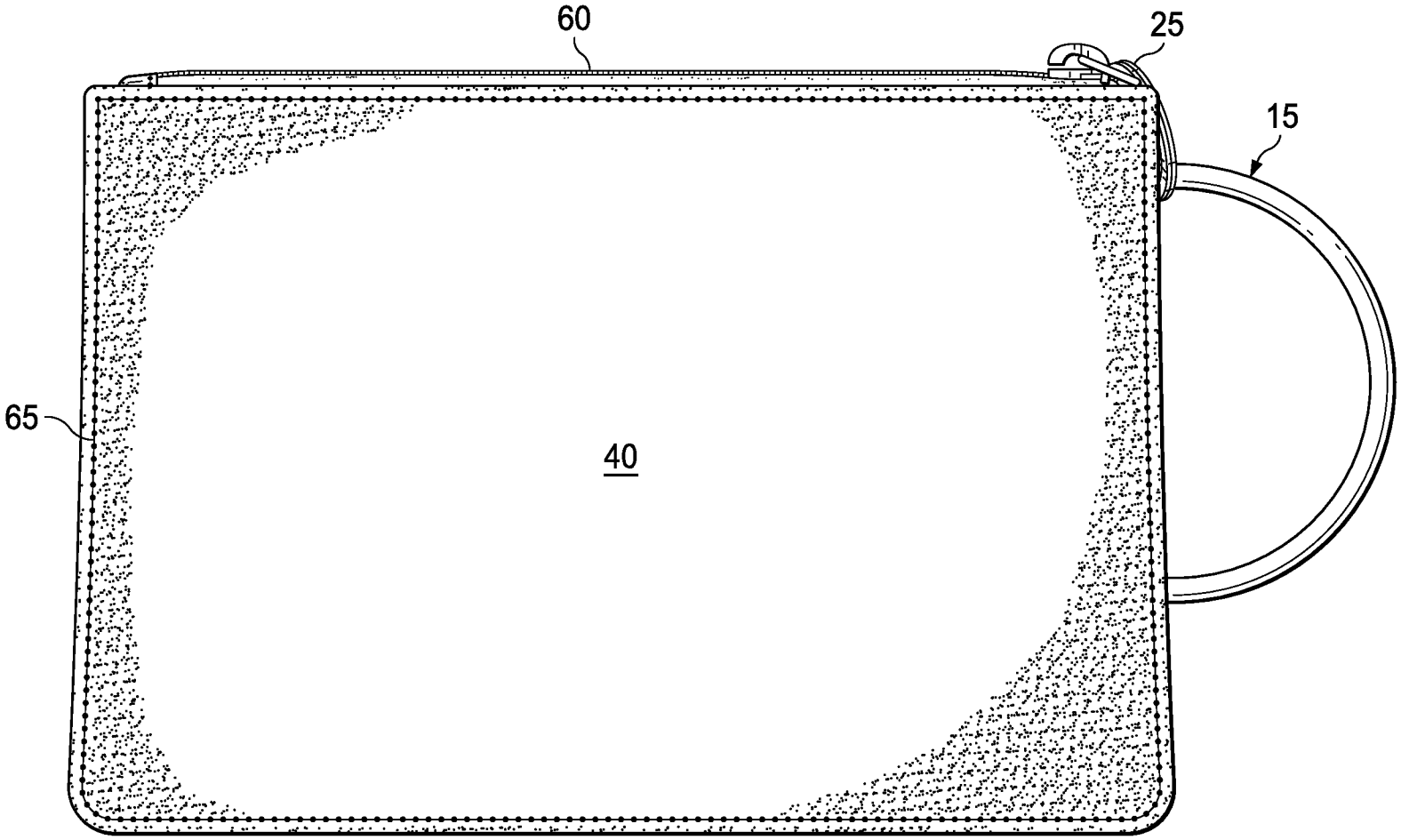
FIG. 3 is a rear elevational view of the personal item management apparatus of FIG. 1, according to one or more embodiments.

As shown in FIG. 2A, the side panel 35 is generally rectangular in shape and is coupled at each of its sides, via the stitching 65, to one of: the zipper 60, the end panel 45, the bottom panel 55, and the end panel 50. The side panel 35 has a length 35*a*. In several embodiments, the length 35*a* is about 21.4 cm. As shown in FIG. 3, in several embodiments, the side panel 40 is identical or nearly identical to the side panel 35 and therefore will not be described in further detail.

Figure 5:
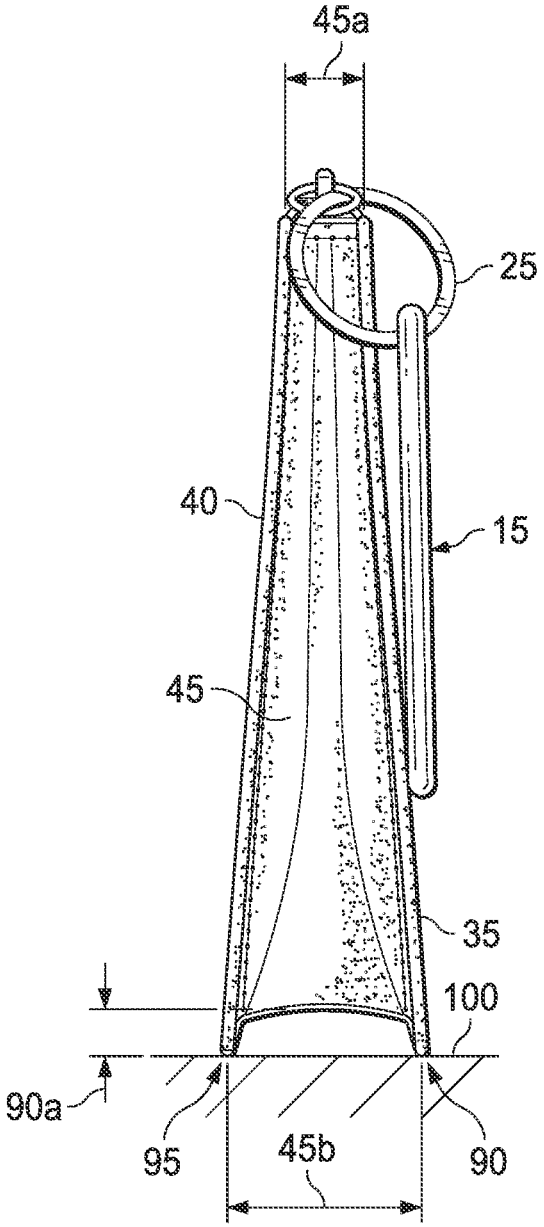
FIG. 5 is a left side elevational view of the personal item management apparatus of FIG. 1, according to one or more embodiments.
Figure 6:
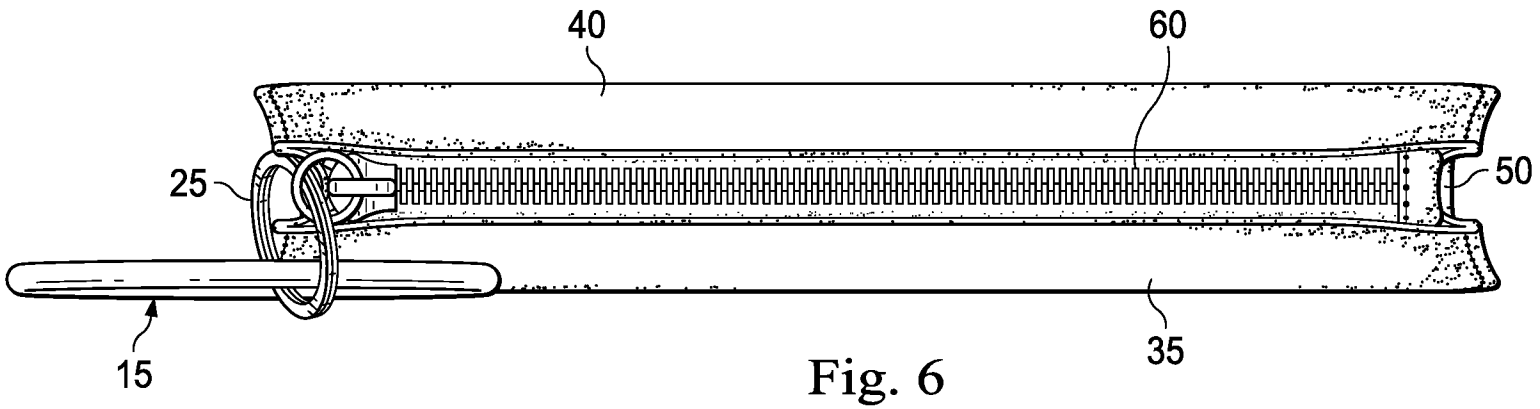
FIG. 6 is a top plan view of the personal item management apparatus of FIG. 1, according to one or more embodiments.

As shown in FIG. 5, the end panel 45 is coupled at each of its sides, via the stitching 65, to one of: the side panel 35, the bottom panel 55, and the side panel 40. In several embodiments, the end panel 45 is also coupled at one or more of its sides, via the stitching 65, to the zipper 60. The end panel 45 defines an upper dimension 45*a*, a lower dimension 45*b*, and a height 45*c*. In several embodiments, the upper dimension 45*a* is about 1.5 cm. In several embodiments, the lower dimension 45*b* about 3.5 cm. In several embodiments, the height 45*c* is about 14.9 cm. In several embodiments, a ratio of the lower dimension 45*b* to the upper dimension 45*a* is about 2.33. In several embodiments, the side panel 35 has a slope of about 14.9. In several embodiments, a ratio of the height 45*c* to the lower dimension 45*b* is about 4.3. However, the slope may be between about 12 and about 16, the ratio of the height 45*c* to the lower dimension 45*b* may be between about 3 and about 5, and the ratio of the lower dimension 45*b* to the upper dimension 45*a* may be between about 3 and about 7. In several embodiments, the ratio of the outer diameter 15*b* of the band 15 to the lower dimension 45*b* of the end panel 45 is 2.4 but may be anywhere between about 1.5 and about 3.

Figure 4:
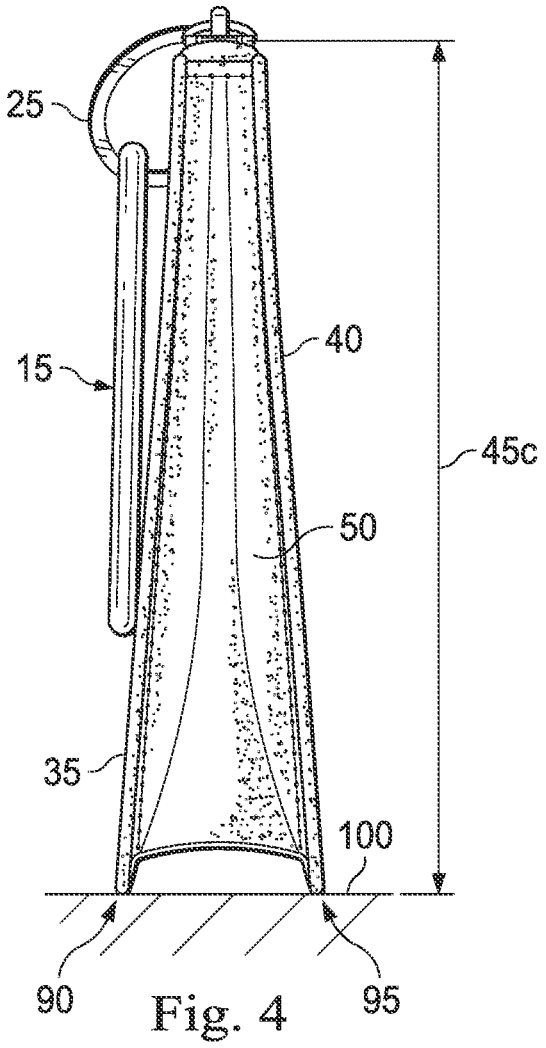
FIG. 4 is a right side elevational view of the personal item management apparatus of FIG. 1, according to one or more embodiments.

In several embodiments, as in FIG. 5, the end panel 45 puckers (e.g., inwardly or outwardly); this puckering of the end panel 45 allows the interior region 51 of the apparatus 10 to be expanded or collapsed proximate the end panel 45. As shown in FIG. 4, in several embodiments, the end panel 50 is identical or nearly identical to the end panel 45 and therefore will not be described in further detail.

As shown in FIGS. 7 and 8, the bottom panel 55 is generally rectangular in shape and is coupled at each of its sides, via the stitching 65, to one of: the side panel 35, the end panel 45, the end panel 50, and the side panel 40. In several embodiments, as in FIGS. 4 and 5, the bottom panel 55 puckers (e.g., inwardly or outwardly); this puckering of the bottom panel 55 allows the interior region 51 of the apparatus 10 to be expanded or collapsed proximate the bottom panel 55.

Figure 9:
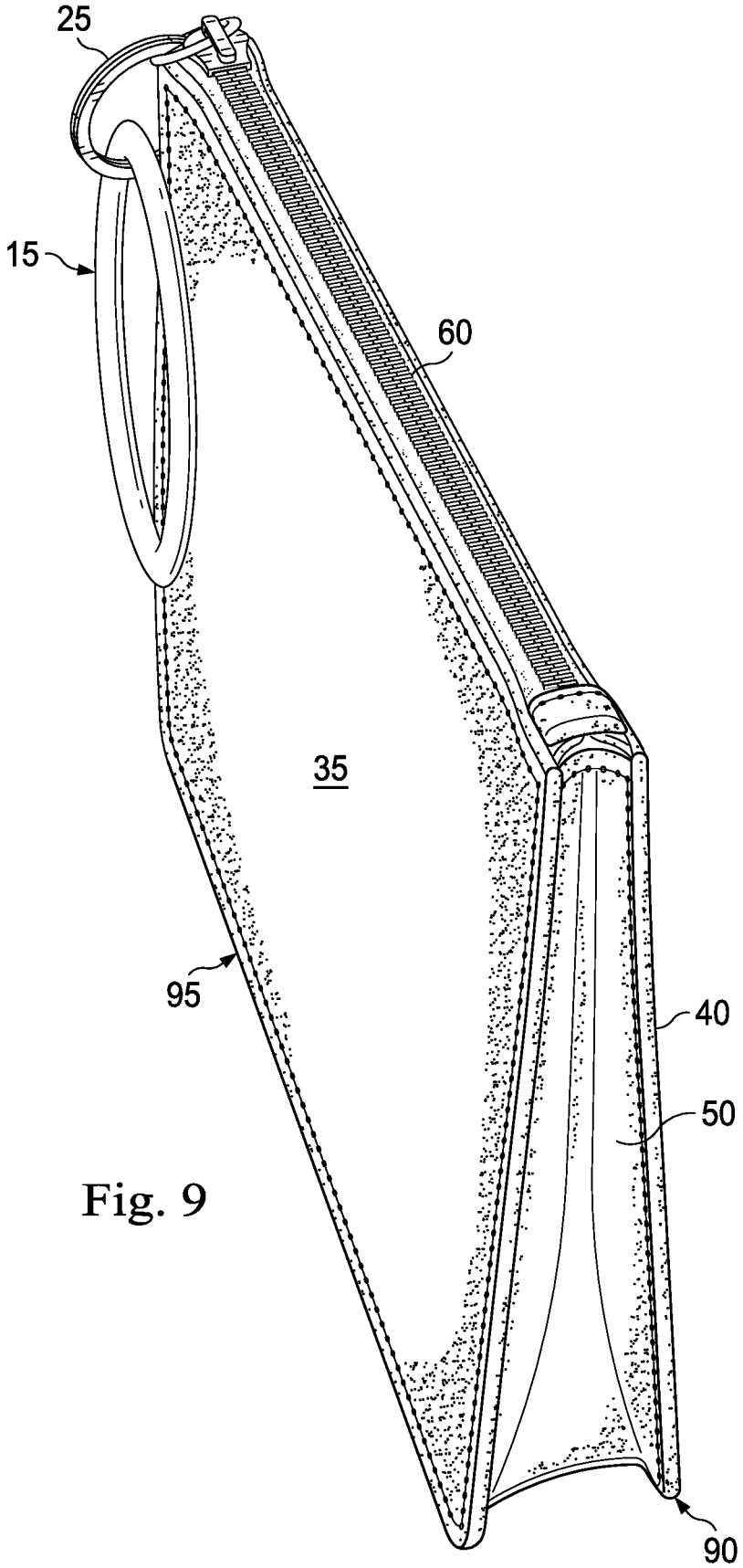
FIG. 9 is yet another perspective view of the personal item management apparatus of FIG. 1, according to one or more embodiments.

As shown in FIGS. 1, 8, and 9, each of the end panels 45 and 50 is (externally) concave relative to the stitching 65 that couples each of the end panels 45 and 50 to the side panels 35 and 40. The bottom panel 55 is also (externally) concave relative to the stitching 65 that couples the bottom panel 55 to each of the side panels 35 and 40 and/or to each of the end panels 45 and 50. As such, edges of the side panels 35 and 40, the end panels 45 and 50, and the bottom panel 55, that extend beyond the stitching 65 form, at least in part, feet 90 and 95 that are configured to contact a flat surface 100 (shown in FIGS. 4 and 5) upon which the apparatus 10 rests. In several embodiments, the seam allowances 80 where the bottom panel 55 and the side panel 35 are coupled together form the foot 90, and the seam allowances 80 where the bottom panel 55 and the side panel 40 are coupled together form the foot 95.

As shown in FIG. 8, at a corner 96 of the bag 20, the stitching 65 that couples the bottom panel 55 to the end panel 45 is spaced apart from the stitching 65 that couples the bottom panel 55 to the side panel 40 by at least a dimension identified by reference numeral 97. Similarly, at a corner 98 of the bag 20, the stitching 65 that couples the bottom panel 55 to the end panel 50 is spaced apart from the stitching 65 that couples the bottom panel 55 to the side panel 40 by at least a dimension identified by reference numeral 99. The bag 20 further defines another two corners opposite the corners 96 and 98, at which two corners the stitching 65 that couples the bottom panel 55 to the end panels 45 and 50, respectively, is similarly spaced apart from the stitching 65 that couples the bottom panel 55 to the side panel 35. In several embodiments, the dimensions 97 and 99 are about 0.5 cm; however, the dimensions 97 and 99 may be anywhere between about 1.25 cm and about 0.25 cm.

As shown in FIGS. 4 and 5, when resting on the flat surface 100, the majority of the bottom panel 55 is spaced apart from the flat surface 100. As a result, the feet 90 and 95 provide support for the apparatus 10. The feet 90 and 95 each have a height 90*a*. In several embodiments, the height 90*a* is about 0.7 cm; however, the height 90*a* may be anywhere between about 0.3 cm and about 1.5 cm. In several embodiments, the dimensions 97 and 99 contribute to the height 90*a* of the foot 90. As such, the apparatus 10 is configured to stand upright upon the flat surface 100 using the feet 90 and 95. Moreover, as described, the apparatus 10 is sized to remain stable when supported upright on the feet 90 and 95. Since the majority of the bottom panel 55 is spaced apart from the flat surface 100, the cleanliness of the bag 20 is preserved.

As shown in FIGS. 1, 2A, 3-5 and 9, the zipper 60 is coupled to the side panels 35 and 40 to enable a user to easily access the interior region 51 of the bag 20. In an embodiment, the clasp 25 may be or include one or more key rings or other similar couplers. In several embodiments, the clasp 25 (or a portion thereof) has an outer diameter of about 3 cm and an inner diameter of about 2.5 cm; however, the outer diameter may be between about 5 cm and about 2 cm and the inner diameter may be between about 4.5 cm and about 1.5 cm. Regardless of size, the clasp 25 couples the zipper 60 to the wearable band 15 such that, when the band 15 is hanging from the clasp 25, a bottom of the band 15 is between about 5 cm and about 7 cm from the feet 90 and 95, and a top of the band 15 is between about 1 cm and about 2 cm from the zipper 60. As a result, when the band 15 is hanging from the clasp 25, the opening 15*e* extends over a midpoint of the height of the bag 20. In an embodiment, the clasp 25 is a self-locking clasp instead of a traditional split-ring key ring.

The apparatus 10 may be slid over the wrist of a wearer, or user. Generally, the band 15 is somewhat larger than the wrist of the wearer such that the band 15 may be comfortably disposed on the wrist like a bracelet. From the foregoing, it should be recognized that the apparatus 10 gives individuals a comfortable, hands-free way to stay organized and carry desired items on their wrists. Moreover, the apparatus 10 is self-standing to prevent the bag 20 from falling over and spilling items that are stored in the bag 20 and/or rearranging items that are stored in the bag 20. Moreover, the apparatus 10 provides a wearable band 15 that retains its shape (e.g., circular) to enable a user to easily insert his or her hand into the opening 15*e* of the band.

Figure 10:
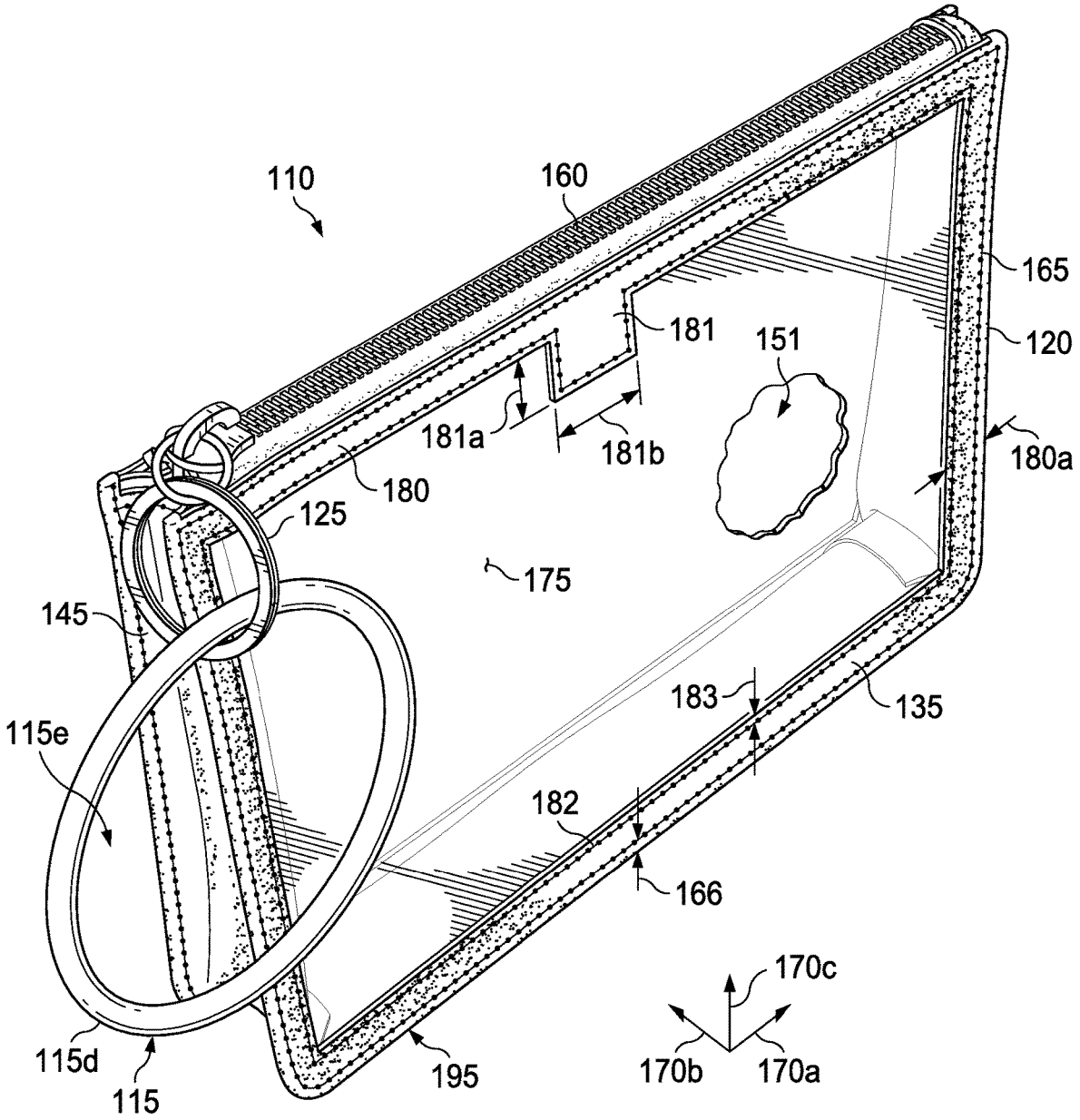
FIG. 10 is a perspective view of another personal item management apparatus, according to one or more embodiments.

Referring to FIG. 10, in an embodiment, a personal item management apparatus is generally referred to by the reference numeral 110 and includes a ring, or wearable band 115, a bag 120, and a clasp 125 coupled to the band 115 and the bag 120. As will be more fully explained below, the apparatus 110 aims to give individuals a comfortable, hands-free way to stay organized and carry their personal items in a bag. The apparatus 110 is self-standing, which permits the bag 120 to be stored in an upright position to enable greater access to personal items in the bag 120 and reduces the surface area of the bag 120 that contacts a surface, such as a table or a floor, when the bag is placed thereon.

Figure 11:
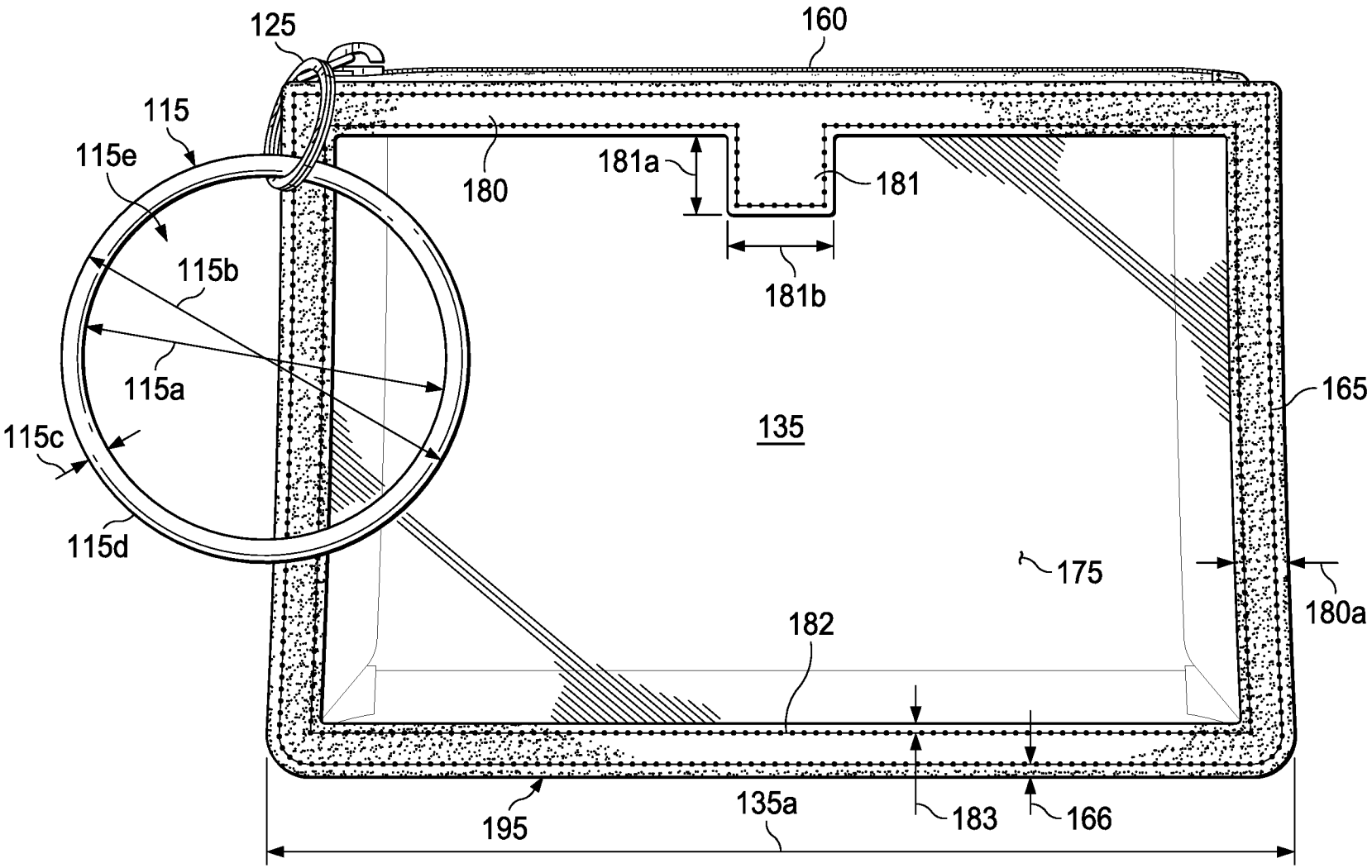
FIG. 11 is a front elevational view of the personal item management apparatus of FIG. 10, according to one or more embodiments.

Referring to FIG. 11, the band 115 may be a continuous and uninterrupted ring. The band 115 has an inner diameter 115*a* and an outer diameter 115*b*. In several embodiments, the inner diameter 115*a* is about (i.e., +/−10%) 7.6 cm and the outer diameter 115*b* is about 8.4 cm. In several embodiments, the inner diameter 115*a* is between about 8 cm and about 6 cm and the outer diameter 115*b* is between about 10 cm and about 7 cm. The band 115 generally has a thickness 115*c* of about 0.4 cm but the thickness 115*c* can be anywhere between about 0.25 cm and about 1.25 cm. Generally, an exterior surface 115*d* of the band 115 is a smooth surface but in several embodiments the exterior surface 115*d* is or includes a textured surface or a patterned surface.

In several embodiments, the band 115 has a solid, circular cross section similar to the cross section of the band 15 shown in FIG. 2B. In addition, or instead, the cross section of the band 115, or a portion thereof, may form any other shape (e.g., a square, an oval, etc.). Moreover, in several embodiments, rather than having a solid cross section, the band 115 may have a hollow interior. In an embodiment, the band 115 may be formed from waterproof or water-resistant materials or appropriately treated to impart these qualities. In an embodiment, the band 115 has a fixed circumference that defines the inner and outer diameters 115*a* and 115*b*, respectively. As such, the wearable band 115 is always positioned such that a user may insert his or her hand through an opening 115*e* defined by the inner diameter 115*a*. That is, the band 115 does not collapse into a flat-loop-like shape, but instead retains its shape. In several embodiments, the band 115 is circular. In several embodiments, the band 115 is rigid or semirigid.

In an embodiment, the band 115 is sized and dimensioned to slide over the wrist of a wearer; as a result, the band 115 may be worn like a bracelet. In an embodiment, the band 115 is sized and dimensioned to fit snugly, but comfortably, around the arm of a wearer; as a result, the band 115 may be worn like an armband. By way of example, the band 115 may be temporarily secured around the bicep or forearm of a wearer. In an embodiment, the band 115 is sized and dimensioned so that the band 115 is unable to slide beyond the forearm or elbow of the wearer. In several embodiments, rather than being a continuous and uninterrupted ring, the band 115 is not a continuous and uninterrupted ring but instead has a break or space along its circumference such that the band 115 forms a "C" shape with a gap (e.g., of less than about 0.5 cm) between the opposing end portions.

Figure 16:
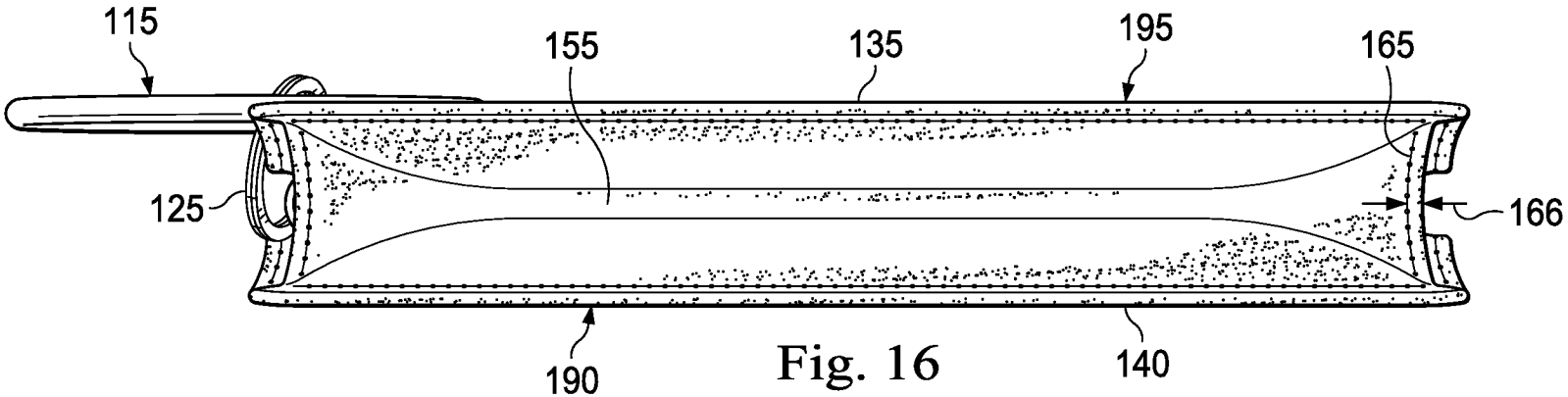
FIG. 16 is a bottom plan view of the personal item management apparatus of FIG. 10, according to one or more embodiments.
Figure 17:
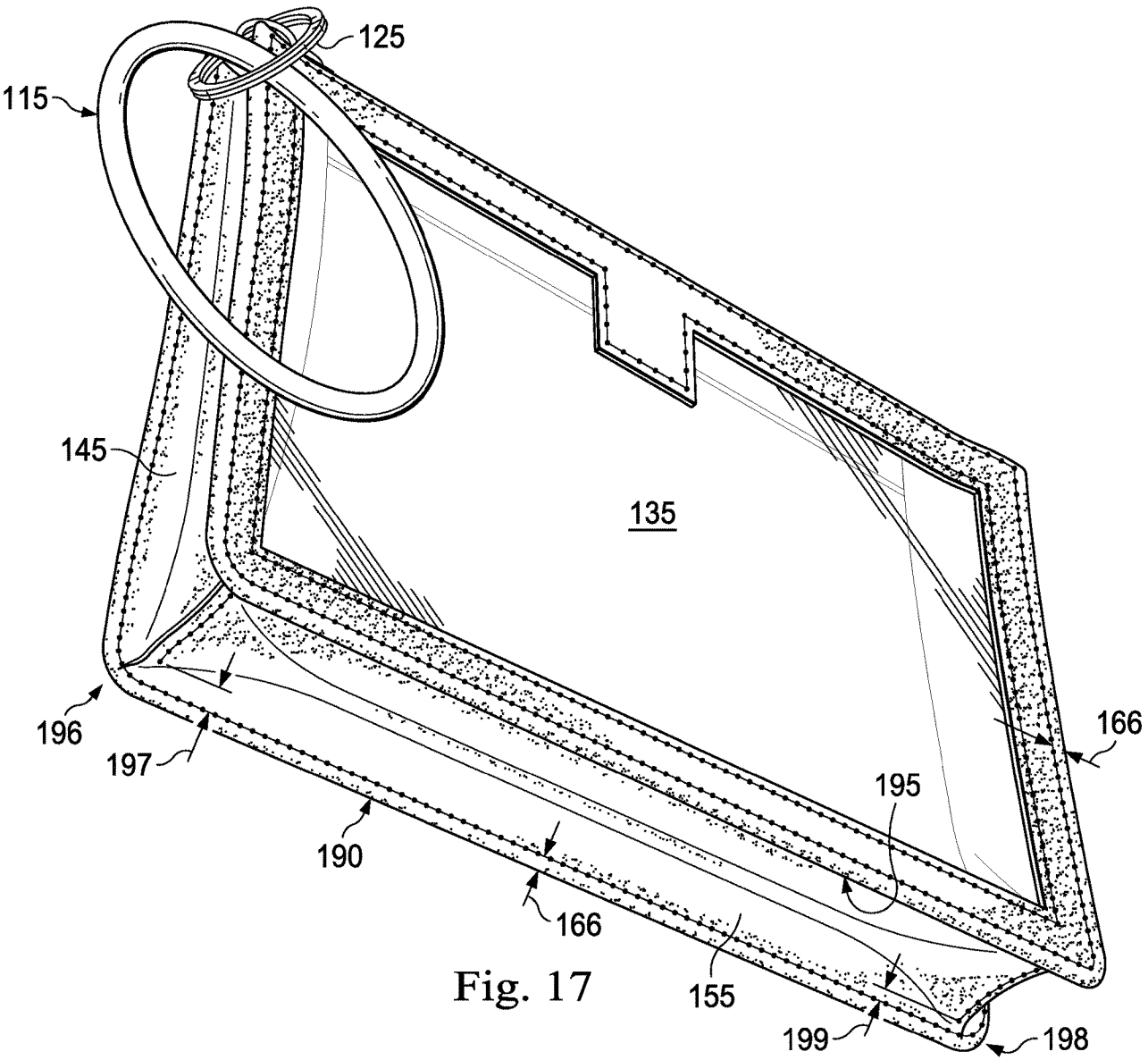
FIG. 17 is another perspective view of the personal item management apparatus of FIG. 10, according to one or more embodiments.

Referring to FIGS. 10-18, in an embodiment, the bag 120 includes opposing side panels 135 (shown in FIGS. 10, 11, and 13-18) and 140 (shown in FIGS. 12-16 and 18), opposing end panels 145 (shown in FIGS. 10 and 14-17) and 150 (shown in FIGS. 13 and 15-18) each coupled to the side panels 135 and 140, and a bottom panel 155 (shown in FIGS. 13, 14, and 16-18) coupled to each of the side panels 135 and 140 and to each of the end panels 145 and 150. As shown in FIG. 10, the bag 120 forms an interior region 151. The bag 120 also includes a zipper 160 (shown in FIGS. 10, 11, 12-15 and 18) that is coupled to each of the side panels 135 and 140. Generally, the side panels 135 and 140, the end panels 145 and 150, the bottom panel 155, and the zipper 160 are coupled via stitching 165. As shown in FIGS. 10, 16, and 17, a seam allowance 166 is defined between the stitching 165 and the nearest edge. In several embodiments, the seam allowance 166 has a dimension of between about 0.1 cm and about 0.4 cm. Moreover, along some, most, or all, of the raw edges adjacent the stitching 165, a lining, edging, or piping extends over and/or between the two edges. In several embodiments, the bag 120 has: a length (measured along an axis identified by reference numeral 170*a* in FIG. 10) of about 21.4 cm; a lower width (measured along an axis identified by reference numeral 170*b* in FIG. 10) of about 3.5 cm; an upper width (measured along an axis identified by the reference numeral 170*b* in FIG. 10) of about 1.5 cm; and a height (measured along an axis identified by reference numeral 170*c* in FIG. 10) of about 14.9 cm. In several embodiments, the ratio of the outer diameter 115*b* of the band 115 to the height of the bag 120 is 0.56 but may be anywhere between about 1 and about 0.25.

Figure 12:
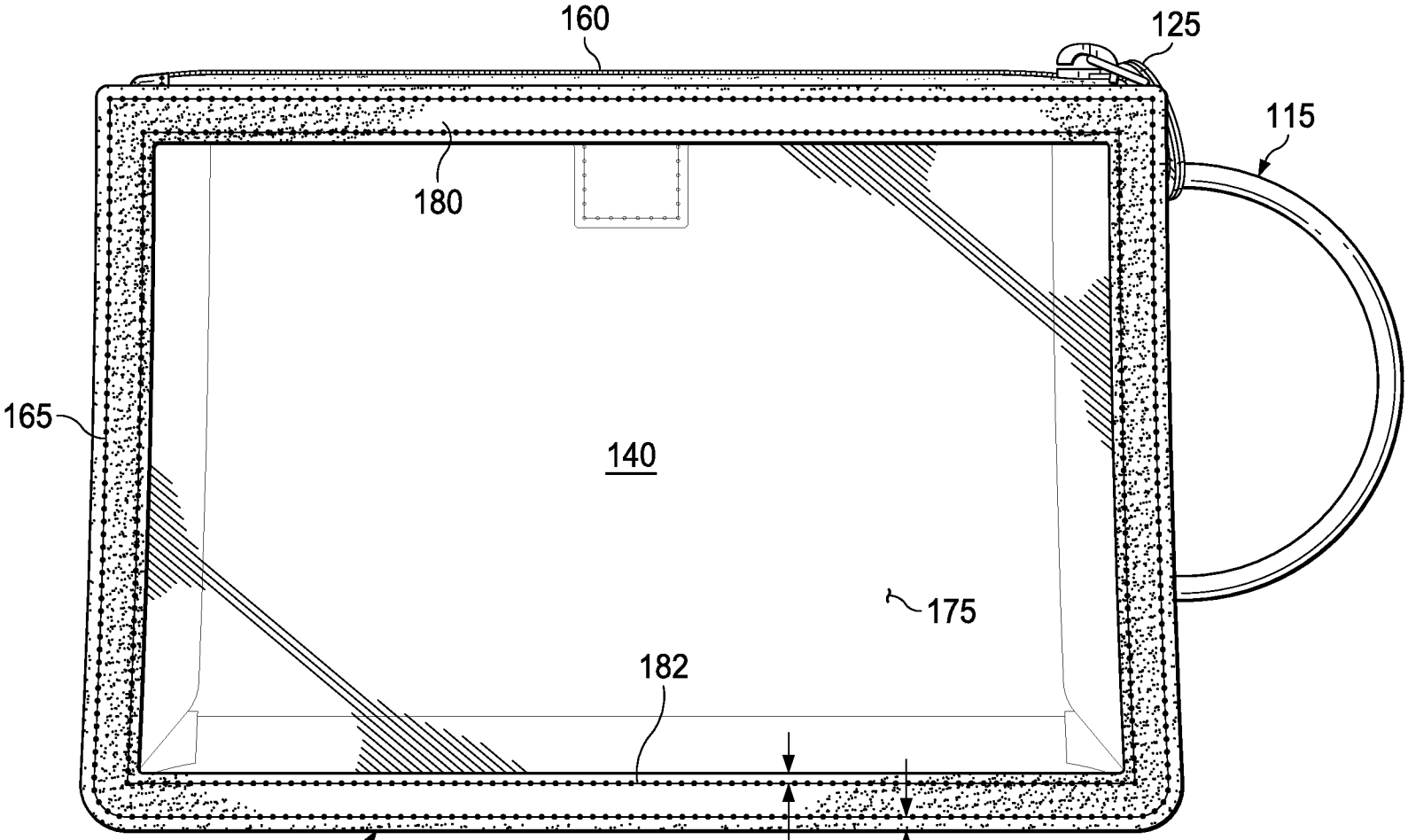
FIG. 12 is a rear elevational view of the personal item management apparatus of FIG. 10, according to one or more embodiments.

As shown in FIG. 11, the side panel 135 is generally rectangular in shape and is coupled at each of its sides, via the stitching 165, to one of: the zipper 160, the end panel 145, the bottom panel 155, and the end panel 150. The side panel 135 has a length 135*a*. In several embodiments, the length 135*a* is about 21.4 cm. The side panel 135 includes an inner panel 175 and an outer border 180. In several embodiments, the inner panel 175 is transparent (or semi-transparent) to permit viewing of the interior 151 without opening the zipper 160; therefore, in several embodiments, the bag 120 is suitable to be taken into a stadium, arena, or other venue at which only transparent or semi-transparent bags can be taken in, for security or other reasons. The outer border 180 is generally rectangular. The outer border 180 has a width 180*a*. In several embodiments the width 180*a* is about 1.4 cm. In several embodiments, the outer border 180 includes tab 181 extending inwardly therefrom. The tab 181 may be embossed, embroidered, or otherwise branded or marked with one or more identifying characteristics. The tab 181 has a length 181*a* and a width 181*b*. In several embodiments, the length 181*a* is about 2.8 cm and the width 181*b* is about 1.9 cm. Generally, the inner panel 175 and the outer border 180 are coupled via stitching 182. A seam allowance 183 is defined between the stitching 182 and the nearest edge. In several embodiments, the seam allowance 183 has a dimension of between about 0.1 cm and about 0.4 cm. Moreover, along some, most, or all, of the raw edge of the outer border 180 adjacent the stitching 182, a lining, edging, or piping extends over the edge. As shown in FIG. 12, in several embodiments, the side panel 140 includes features that are identical or nearly identical to corresponding features of the side panel 135, which identical or nearly identical features are given the same reference numerals; therefore, the side panel 140 will not be described in further detail. In several embodiments, as in FIG. 12, the tab 181 is omitted from the side panel 140. In several embodiments, the tab 181 is omitted from the side panel 135.

Figure 14:
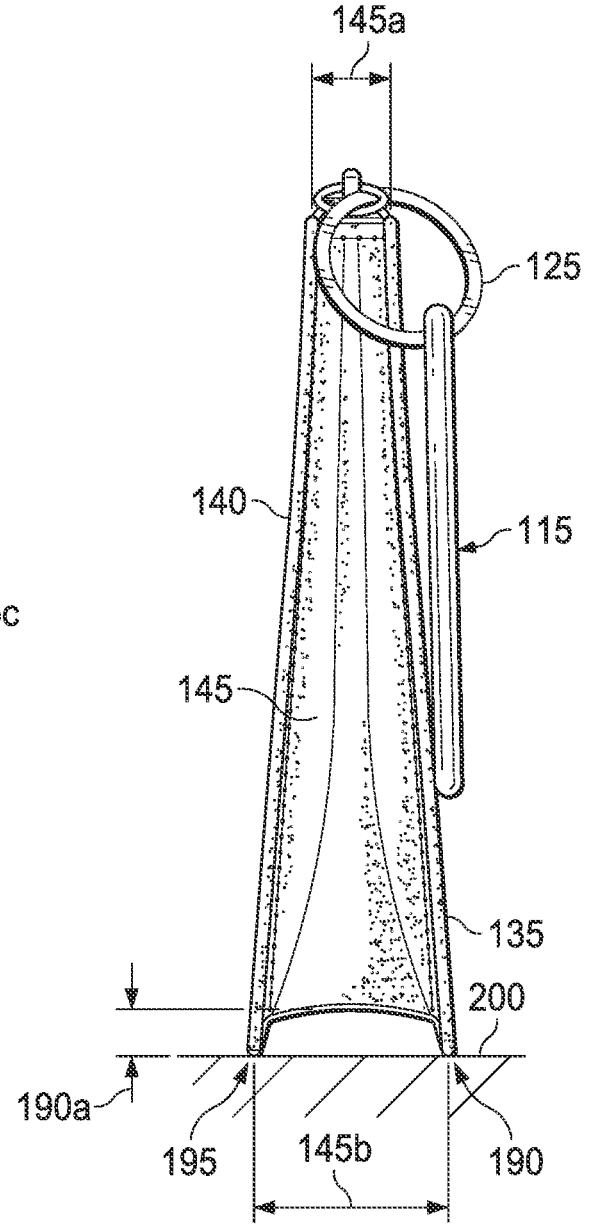
FIG. 14 is a left side elevational view of the personal item management apparatus of FIG. 10, according to one or more embodiments.
Figure 15:
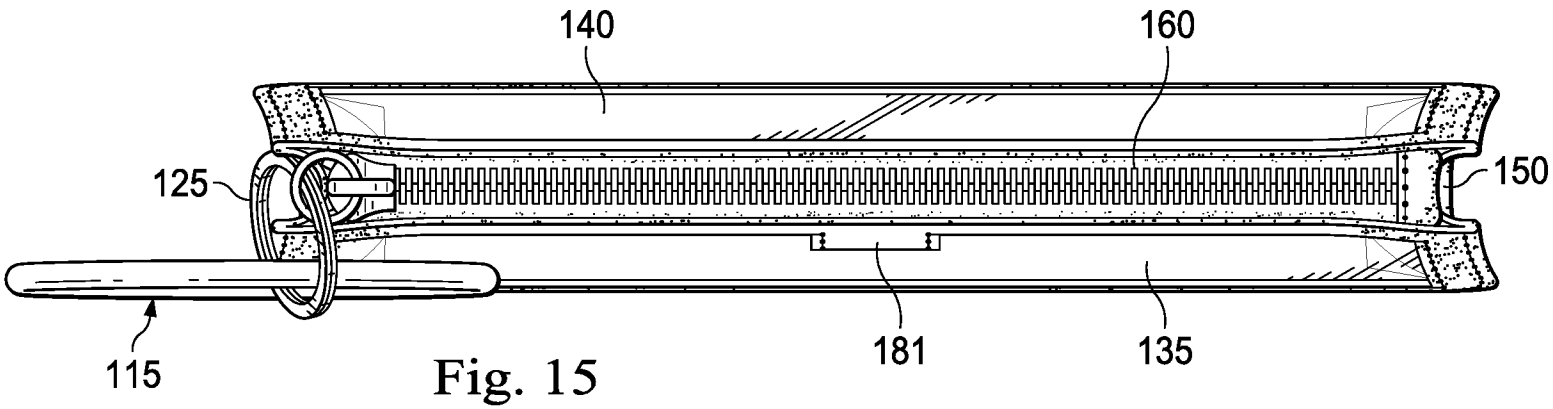
FIG. 15 is a top plan view of the personal item management apparatus of FIG. 10, according to one or more embodiments.

As shown in FIG. 14, the end panel 145 is coupled at each of its sides, via the stitching 165, to one of: the side panel 135, the bottom panel 155, and the side panel 140. In several embodiments, the end panel 145 is also coupled at one or more of its sides, via the stitching 165, to the zipper 160. The end panel 145 defines an upper dimension 145*a*, a lower dimension 145*b*, and a height 145*c*. In several embodiments, the upper dimension 145*a* is about 1.5 cm. In several embodiments, the lower dimension 145*b* about 3.5 cm. In several embodiments, the height 145*c* is about 14.9 cm. In several embodiments, a ratio of the lower dimension 145*b* to the upper dimension 145*a* is about 2.33. In several embodiments, the side panel 135 has a slope of about 14.9. In several embodiments, a ratio of the height 145*c* to the lower dimension 145*b* is about 4.3. However, the slope may be between about 12 and about 16, the ratio of the height 145*c* to the lower dimension 145*b* may be between about 3 and about 5, and the ratio of the lower dimension 145*b* to the upper dimension 145*a* may be between about 3 and about 7. In several embodiments, the ratio of the outer diameter 115*b* of the band 115 to the lower dimension 145*b* of the end panel 145 is 2.4 but may be anywhere between about 1.5 and about 3.

Figure 13:
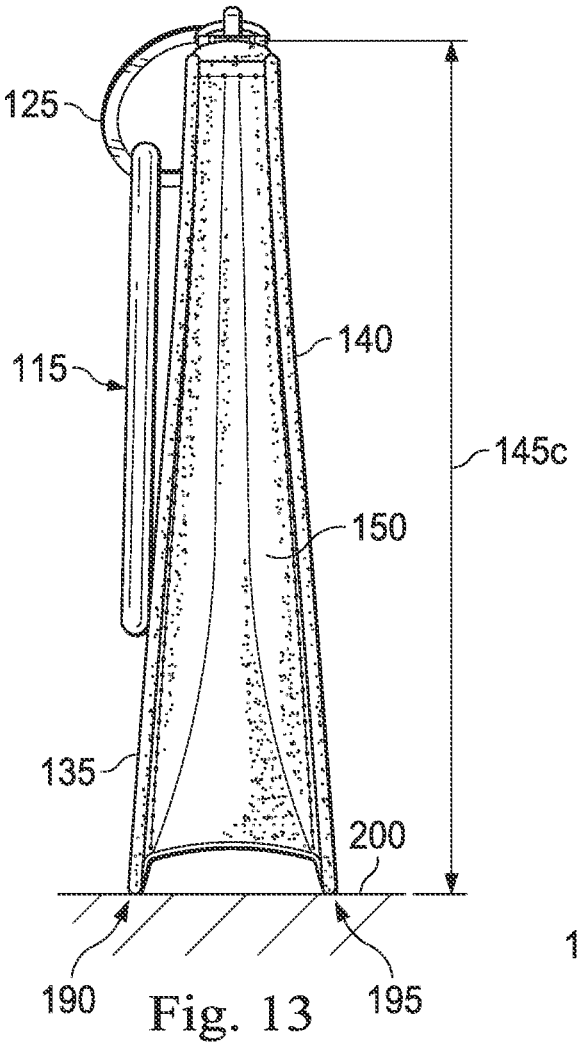
FIG. 13 is a right side elevational view of the personal item management apparatus of FIG. 10, according to one or more embodiments.

In several embodiments, as in FIG. 14, the end panel 145 puckers (e.g., inwardly or outwardly); this puckering of the end panel 145 allows the interior region 151 of the apparatus 110 to be expanded or collapsed proximate the end panel 145. As shown in FIG. 13, in several embodiments, the end panel 150 is identical or nearly identical to the end panel 145 and therefore will not be described in further detail.

As shown in FIGS. 16 and 17, the bottom panel 155 is generally rectangular in shape and is coupled at each of its sides, via the stitching 165, to one of: the side panel 135, the end panel 145, the end panel 150, and the side panel 140. In several embodiments, as in FIGS. 13 and 14, the bottom panel 155 puckers (e.g., inwardly or outwardly); this puckering of the bottom panel 155 allows the interior region 151 of the apparatus 110 to be expanded or collapsed proximate the bottom panel 155.

Figure 18:
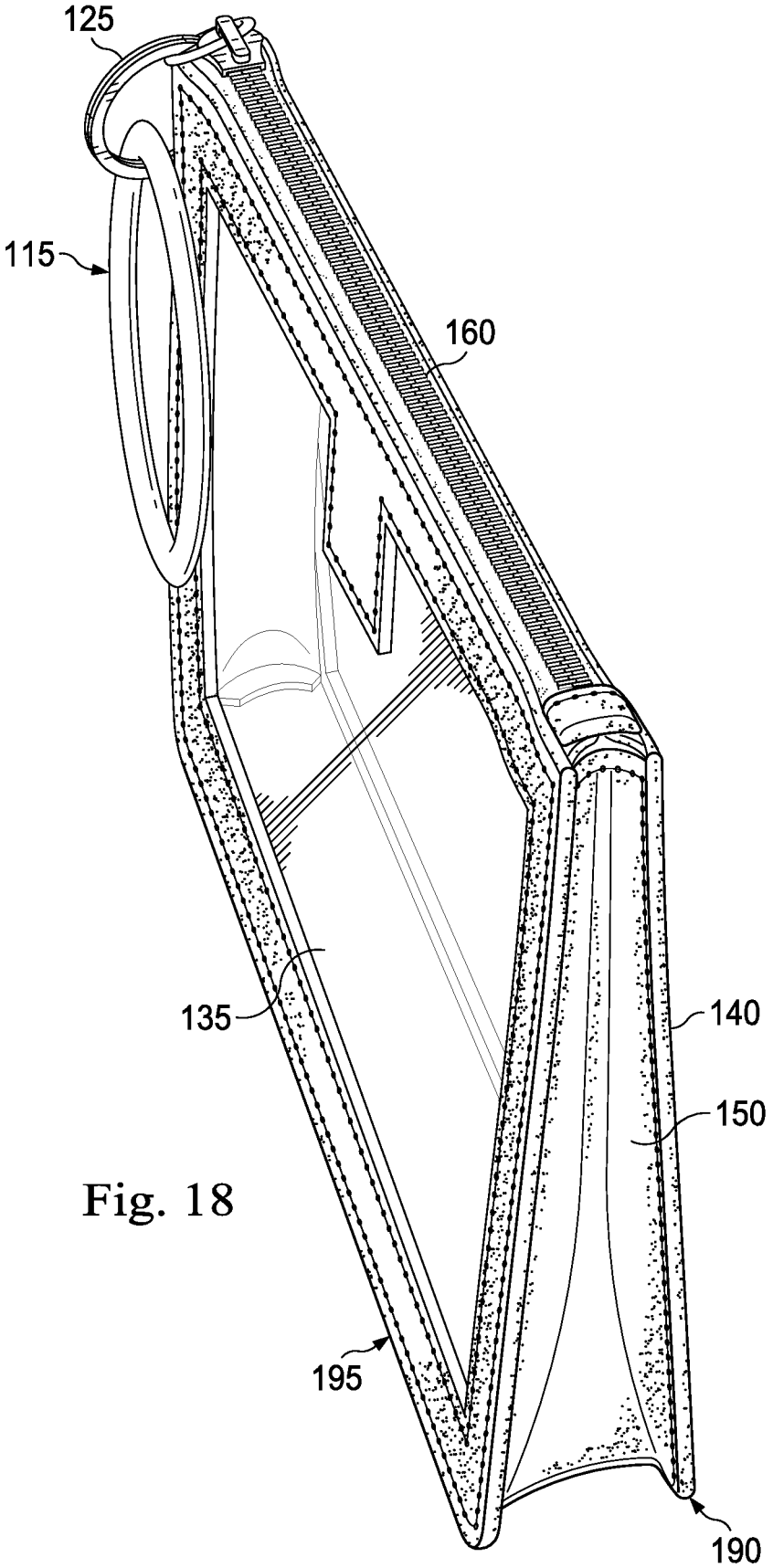
FIG. 18 is yet another perspective view of the personal item management apparatus of FIG. 10, according to one or more embodiments.

As shown in FIGS. 10, 17, and 18, each of the end panels 145 and 150 is (externally) concave relative to the stitching 165 that couples each of the end panels 145 and 150 to the side panels 135 and 140. The bottom panel 155 is also (externally) concave relative to the stitching 165 that couples the bottom panel 155 to each of the side panels 135 and 140 and/or to each of the end panels 145 and 150. As such, edges of the side panels 135 and 140, the end panels 145 and 150, and the bottom panel 155, that extend beyond the stitching 165 form, at least in part, feet 190 and 195 that are configured to contact a flat surface 200 (shown in FIGS. 13 and 14) upon which the apparatus 110 rests. In several embodiments, the seam allowances 166 where the bottom panel 155 and the side panel 135 are coupled together form the foot 190, and the seam allowances 166 where the bottom panel 155 and the side panel 140 are coupled together form the foot 195.

As shown in FIG. 17, at a corner 196 of the bag 120, the stitching 165 that couples the bottom panel 155 to the end panel 145 is spaced apart from the stitching 165 that couples the bottom panel 155 to the side panel 140 by at least a dimension identified by reference numeral 197. Similarly, at a corner 198 of the bag 120, the stitching 165 that couples the bottom panel 155 to the end panel 150 is spaced apart from the stitching 165 that couples the bottom panel 155 to the side panel 140 by at least a dimension identified by reference numeral 199. The bag 120 further defines another two corners opposite the corners 196 and 198, at which two corners the stitching 165 that couples the bottom panel 155 to the end panels 145 and 150, respectively, is similarly spaced apart from the stitching 165 that couples the bottom panel 155 to the side panel 135. In several embodiments, the dimensions 197 and 199 are about 0.5 cm; however, the dimensions 197 and 199 may be anywhere between about 1.25 cm and about 0.25 cm.

As shown in FIGS. 13 and 14, when resting on the flat surface 200, the majority of the bottom panel 155 is spaced apart from the flat surface 200. As a result, the feet 190 and 195 provide support for the apparatus 110. The feet 190 and 195 each have a height 190*a*. In several embodiments, the height 190*a* is about 0.7 cm; however, the height 190*a* may be anywhere between about 0.3 cm and about 1.5 cm. In several embodiments, the dimensions 197 and 199 contribute to the height 190*a* of the foot 190. As such, the apparatus 110 is configured to stand upright upon the flat surface 200 using the feet 190 and 195. Moreover, as described, the apparatus 110 is sized to remain stable when supported upright on the feet 190 and 195. Since the majority of the bottom panel 155 is spaced apart from the flat surface 200, the cleanliness of the bag 120 is preserved.

As shown in FIGS. 10-14 and 18, the zipper 160 is coupled to the side panels 135 and 140 to enable a user to easily access the interior region 151 of the bag 120. In an embodiment, the clasp 125 may be or include one or more key rings or other similar couplers. In several embodiments, the clasp 125 (or a portion thereof) has an outer diameter of about 3 cm and an inner diameter of about 2.5 cm; however, the outer diameter may be between about 5 cm and about 2 cm and the inner diameter may be between about 4.5 cm and about 1.5 cm. Regardless of size, the clasp 125 couples the zipper 160 to the wearable band 115 such that, when the band 115 is hanging from the clasp 125, a bottom of the band 115 is between about 5 cm and about 7 cm from the feet 190 and 195, and a top of the band 115 is between about 1 cm and about 2 cm from the zipper 160. As a result, when the band 115 is hanging from the clasp 125, the opening 115*e* extends over a midpoint of the height of the bag 120. In an embodiment, the clasp 125 is a self-locking clasp instead of a traditional split-ring key ring.

The apparatus 110 may be slid over the wrist of a wearer, or user. Generally, the band 115 is somewhat larger than the wrist of the wearer such that the band 115 may be comfortably disposed on the wrist like a bracelet. From the foregoing, it should be recognized that the apparatus 110 gives individuals a comfortable, hands-free way to stay organized and carry desired items on their wrists. Moreover, the apparatus 110 is self-standing to prevent the bag 120 from falling over and spilling items that are stored in the bag 120 and/or rearranging items that are stored in the bag 120. Moreover, the apparatus 110 provides a wearable band 115 that retains its shape (e.g., circular) to enable a user to easily insert his or her hand into the opening 115*e* of the band.

Figure 19:
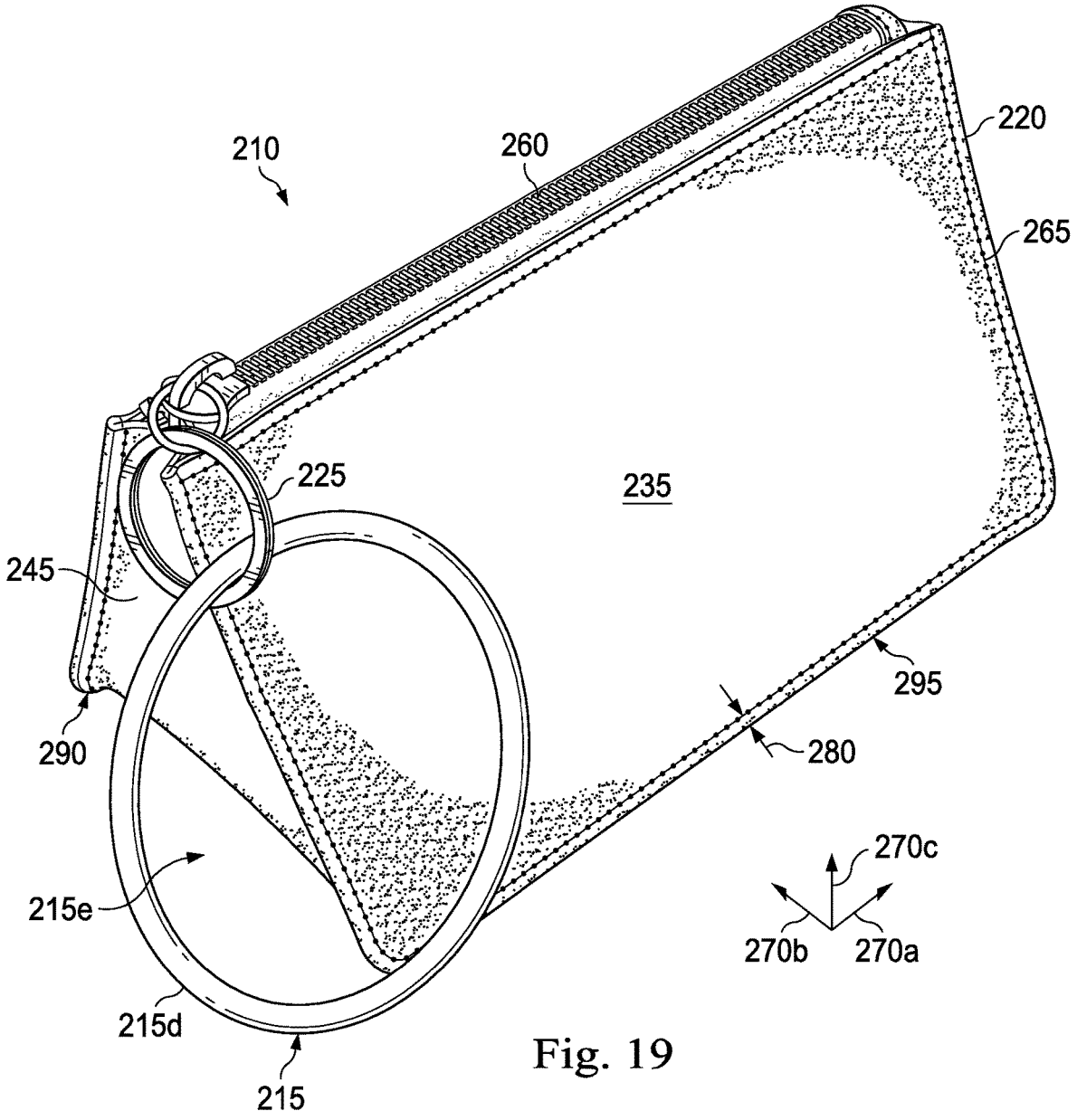
FIG. 19 is a perspective view of yet another personal item management apparatus, according to one or more embodiments.

Referring to FIG. 19, in an embodiment, a personal item management apparatus is generally referred to by the reference numeral 210 and includes a ring, or wearable band 215, a bag 220, and a clasp 225 coupled to the band 215 and the bag 220. As will be more fully explained below, the apparatus 210 aims to give individuals a comfortable, hands-free way to stay organized and carry their personal items in a bag. The apparatus 210 is self-standing, which permits the bag 220 to be stored in an upright position to enable greater access to personal items in the bag 220 and reduces the surface area of the bag 220 that contacts a surface, such as a table or a floor, when the bag is placed thereon.

Figure 20:
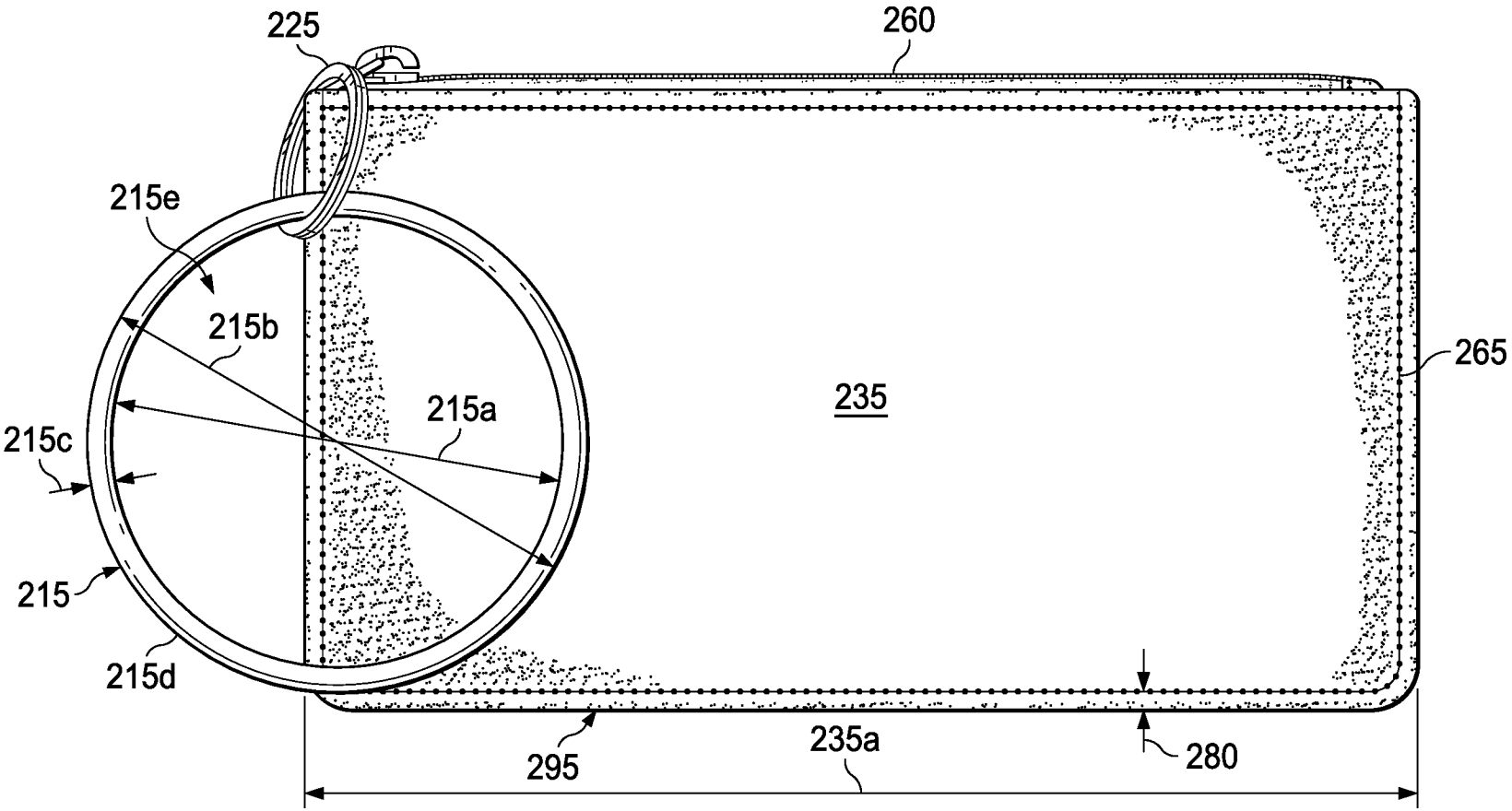
FIG. 20 is a front elevational view of the personal item management apparatus of FIG. 19, according to one or more embodiments.

Referring to FIG. 20, the band 215 may be a continuous and uninterrupted ring. The band 215 has an inner diameter 215*a* and an outer diameter 215*b*. In several embodiments, the inner diameter 215*a* is about (i.e., within +/−10%) 7.6 cm and the outer diameter 215*b* is about 8.4 cm. In several embodiments, the inner diameter 215*a* is between about 8 cm and about 6 cm and the outer diameter 215*b* is between about 10 cm and about 7 cm. The band 215 generally has a thickness 215*c* of about 0.4 cm but the thickness 215*c* can be anywhere between about 0.25 cm and about 1.25 cm. Generally, an exterior surface 215*d* of the band 215 is a smooth surface but in several embodiments the exterior surface 215*d* is or includes a textured surface or a patterned surface.

In several embodiments, the band 215 has a solid, circular cross section similar to the cross section of the band 15 shown in FIG. 2B. In addition, or instead, the cross section of the band 215, or a portion thereof, may form any other shape (e.g., a square, an oval, etc.). Moreover, in several embodiments, rather than having a solid cross section, the band 215 may have a hollow interior. In an embodiment, the band 215 may be formed from waterproof or water-resistant materials or appropriately treated to impart these qualities. In an embodiment, the band 215 has a fixed circumference that defines the inner and outer diameters 215*a* and 215*b*, respectively. As such, the wearable band 215 is always positioned such that a user may insert his or her hand through an opening 215*e* defined by the inner diameter 215*a*. That is, the band 215 does not collapse into a flat-loop-like shape, but instead retains its shape. In several embodiments, the band 215 is circular. In several embodiments, the band 215 is rigid or semirigid.

In an embodiment, the band 215 is sized and dimensioned to slide over the wrist of a wearer; as a result, the band 215 may be worn like a bracelet. In an embodiment, the band 215 is sized and dimensioned to fit snugly, but comfortably, around the arm of a wearer; as a result, the band 215 may be worn like an armband. By way of example, the band 215 may be temporarily secured around the bicep or forearm of a wearer. In an embodiment, the band 215 is sized and dimensioned so that the band 215 is unable to slide beyond the forearm or elbow of the wearer. In several embodiments, rather than being a continuous and uninterrupted ring, the band 215 is not a continuous and uninterrupted ring but instead has a break or space along its circumference such that the band 215 forms a "C" shape with a gap (e.g., of less than about 0.5 cm) between the opposing end portions.

Figure 25:
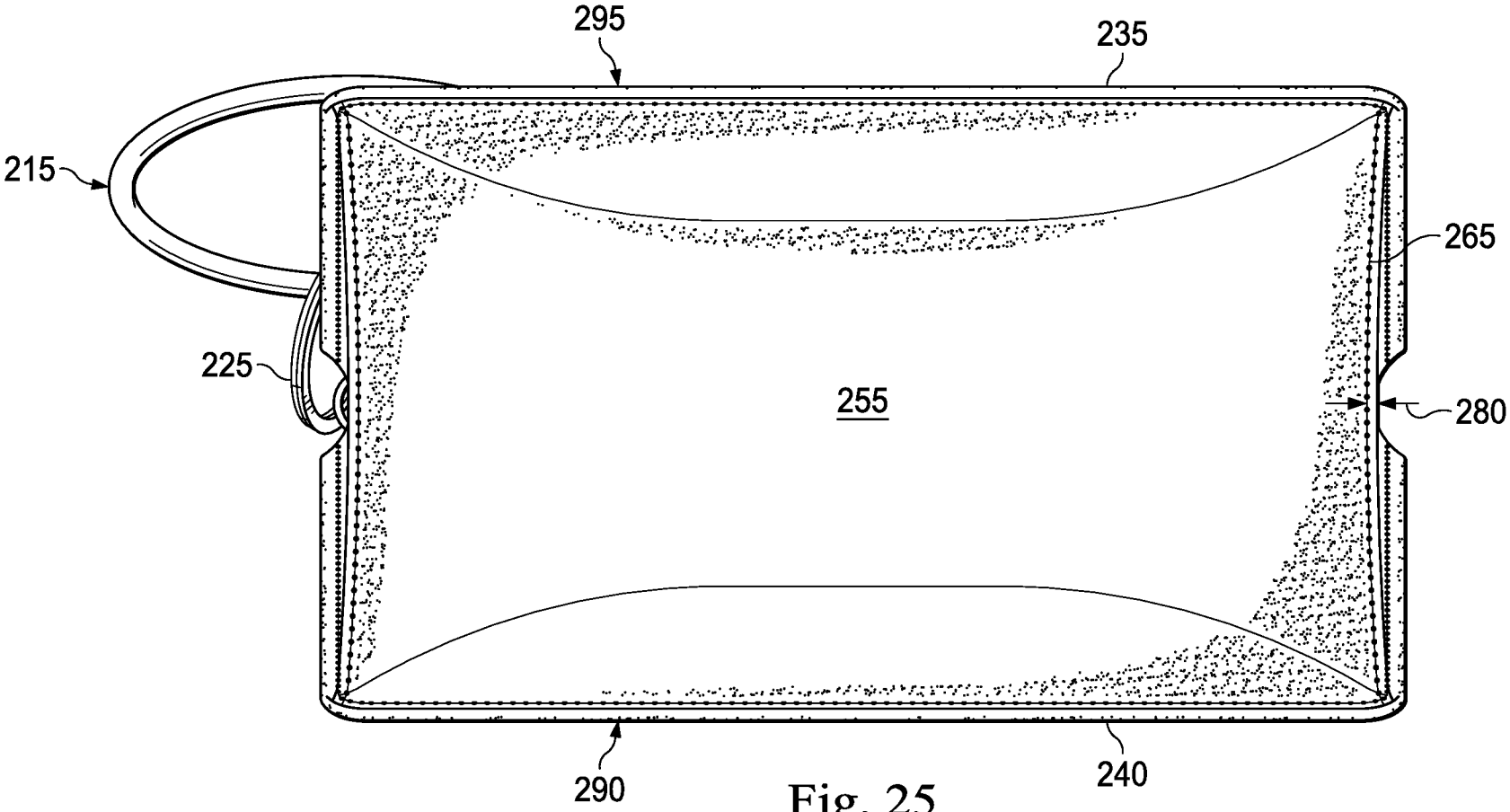
FIG. 25 is a bottom plan view of the personal item management apparatus of FIG. 19, according to one or more embodiments.
Figure 26:
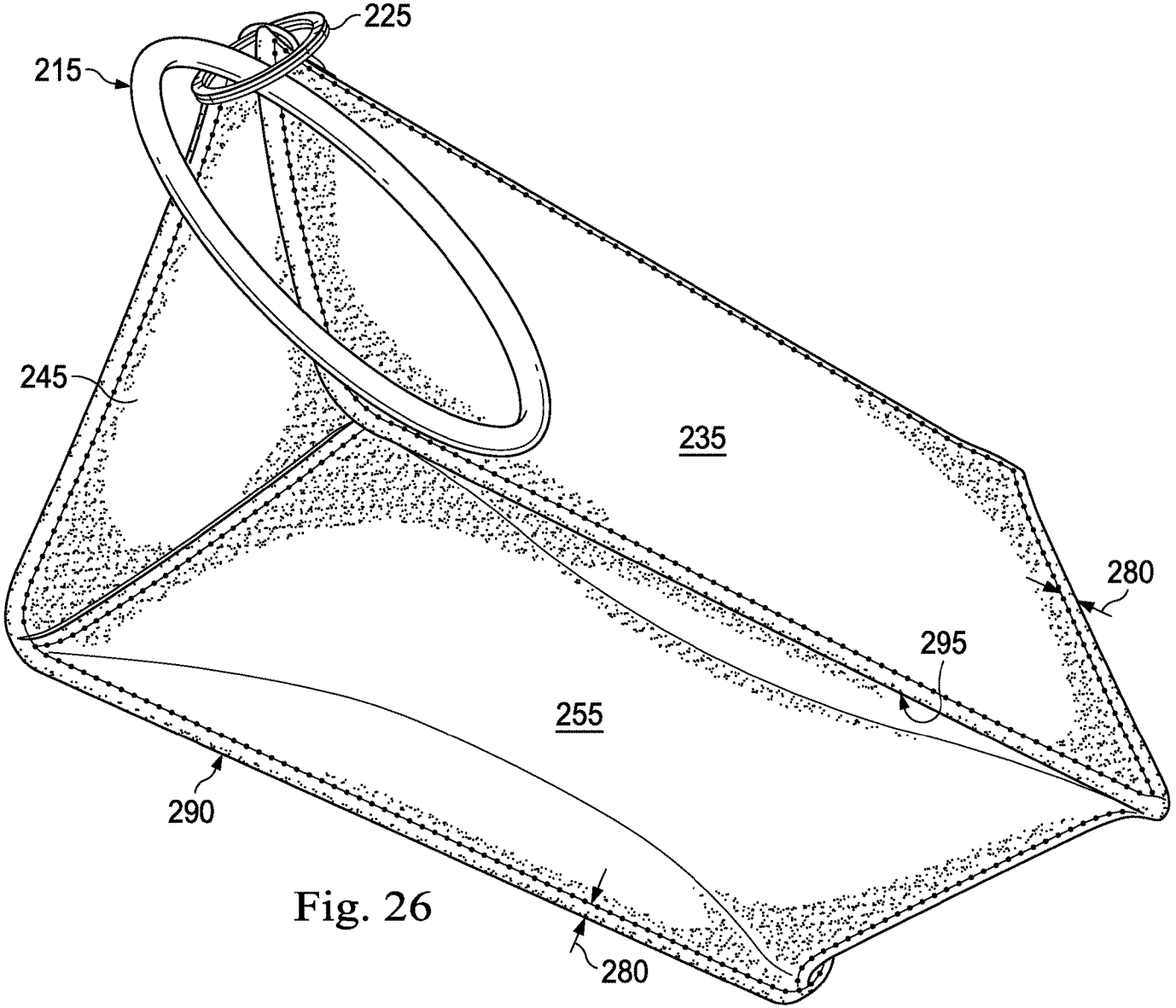
FIG. 26 is another perspective view of the personal item management apparatus of FIG. 19, according to one or more embodiments.

Referring to FIGS. 19-27, in an embodiment, the bag 220 includes opposing side panels 235 (shown in FIGS. 19, 20, and 22-27) and 240 (shown in FIGS. 21-25 and 27), opposing end panels 245 (shown in FIGS. 19 and 23-26) and 250 (shown in FIGS. 22 and 24-27) each coupled to the side panels 235 and 240, and a bottom panel 255 (shown in FIGS. 22, 23, and 25-27) coupled to each of the side panels 235 and 240 and to each of the end panels 245 and 250. As shown in FIG. 19, the bag 220 forms an interior region 251. The bag 220 also includes a zipper 260 (shown in FIGS. 19-24 and 27) that is coupled to each of the side panels 235 and 240. Generally, the side panels 235 and 240, the end panels 245 and 250, the bottom panel 255, and the zipper 260 are coupled via stitching 265. As shown in FIGS. 19, 25, and 26, a seam allowance 280 is defined between the stitching 265 and the nearest edge. In several embodiments, the seam allowance 280 has a dimension of between about 0.1 cm and about 0.4 cm. Moreover, along some, most, or all, of the raw edges adjacent the stitching 265, a lining, edging, or piping extends over and/or between the two edges. In several embodiments, the bag 220 has: a length (measured along an axis identified by reference numeral 270*a* in FIG. 19) of about 17.5 cm; a lower width (measured along an axis identified by reference numeral 270*b* in FIG. 19) of about 9.5 cm; an upper width (measured along an axis identified by the reference numeral 270*b* in FIG. 19) of about 2.0 cm; and a height (measured along an axis identified by reference numeral 270*c* in FIG. 19) of about 9.2 cm. In several embodiments, the ratio of the outer diameter 215*b* of the band 215 to the height of the bag 220 is 0.91 but may be anywhere between about 1 and about 0.25.

Figure 21:
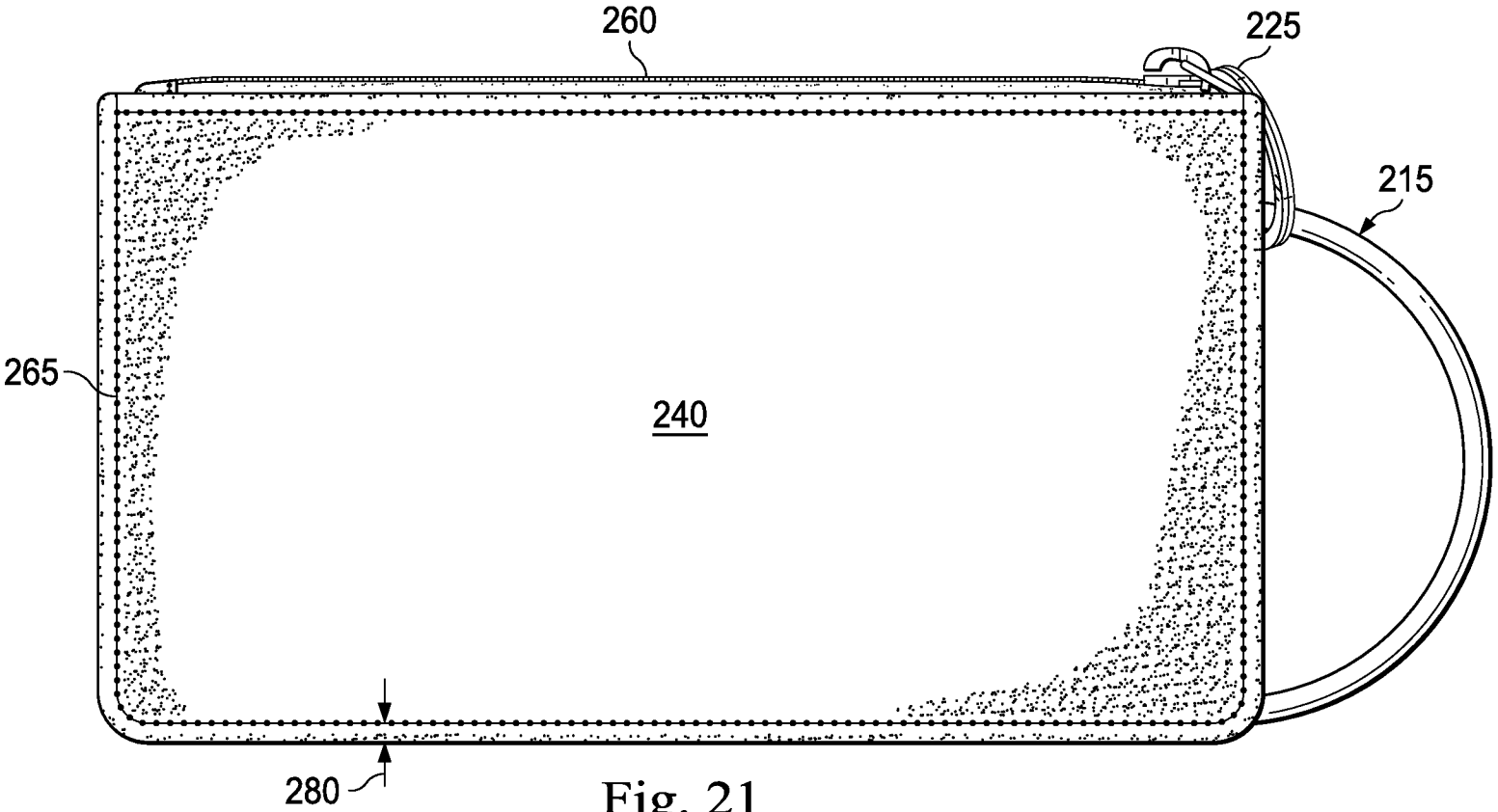
FIG. 21 is a rear elevational view of the personal item management apparatus of FIG. 19, according to one or more embodiments.

As shown in FIG. 20, the side panel 235 is generally rectangular in shape and is coupled at each of its sides, via the stitching 265, to one of: the zipper 260, the end panel 245, the bottom panel 255, and the end panel 250. The side panel 235 has a length 235*a*. In several embodiments, the length 235*a* is about 17.5 cm. As shown in FIG. 21, in several embodiments, the side panel 240 is identical or nearly identical to the side panel 235 and therefore will not be described in further detail.

Figure 23:
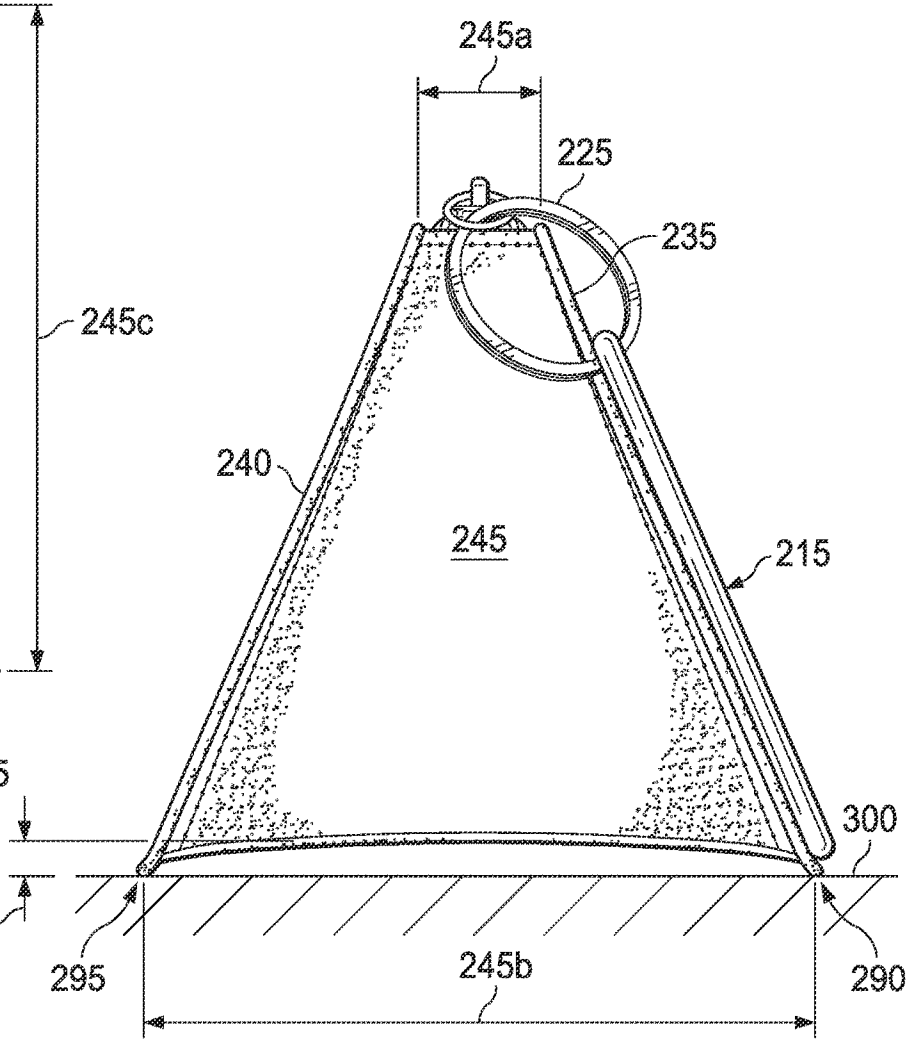
FIG. 23 is a left side elevational view of the personal item management apparatus of FIG. 19, according to one or more embodiments.

As shown in FIG. 23, the end panel 245 is coupled at each of its sides, via the stitching 265, to one of: the side panel 235, the bottom panel 255, and the side panel 240. In several embodiments, the end panel 245 is also coupled at one or more of its sides, via the stitching 265, to the zipper 260. The end panel 245 defines an upper dimension 245*a*, a lower dimension 245*b*, and a height 245*c*. In several embodiments, the upper dimension 245*a* is about 2.0 cm. In several embodiments, the lower dimension 245*b* about 9.5 cm. In several embodiments, the height 245*c* is about 9.2 cm. In several embodiments, a ratio of the lower dimension 245*b* to the upper dimension 245*a* is about 4.75. In several embodiments, the side panel 235 has a slope of about 2.45. In several embodiments, a ratio of the height 245*c* to the lower dimension 245*b* is about 0.97. However, the slope may be between about 1.5 and about 3.5, the ratio of the height 245*c* to the lower dimension 245*b* may be between about 3 and about 5, and the ratio of the lower dimension 245*b* to the upper dimension 245*a* may be between about 0.5 and about 1.5. In several embodiments, the ratio of the outer diameter 215*b* of the band 215 to the lower dimension 245*b* of the end panel 245 is 0.9 but may be anywhere between about 0.5 and about 1.5.

Figure 22:
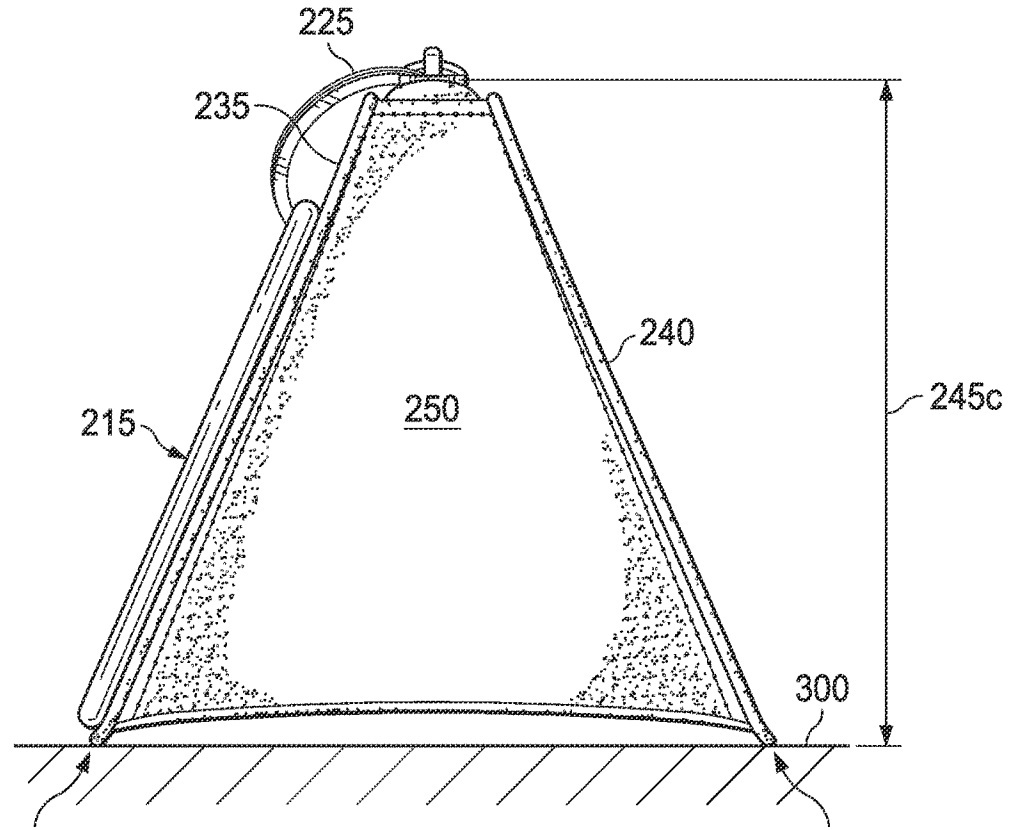
FIG. 22 is a right side elevational view of the personal item management apparatus of FIG. 19, according to one or more embodiments.
Figure 24:
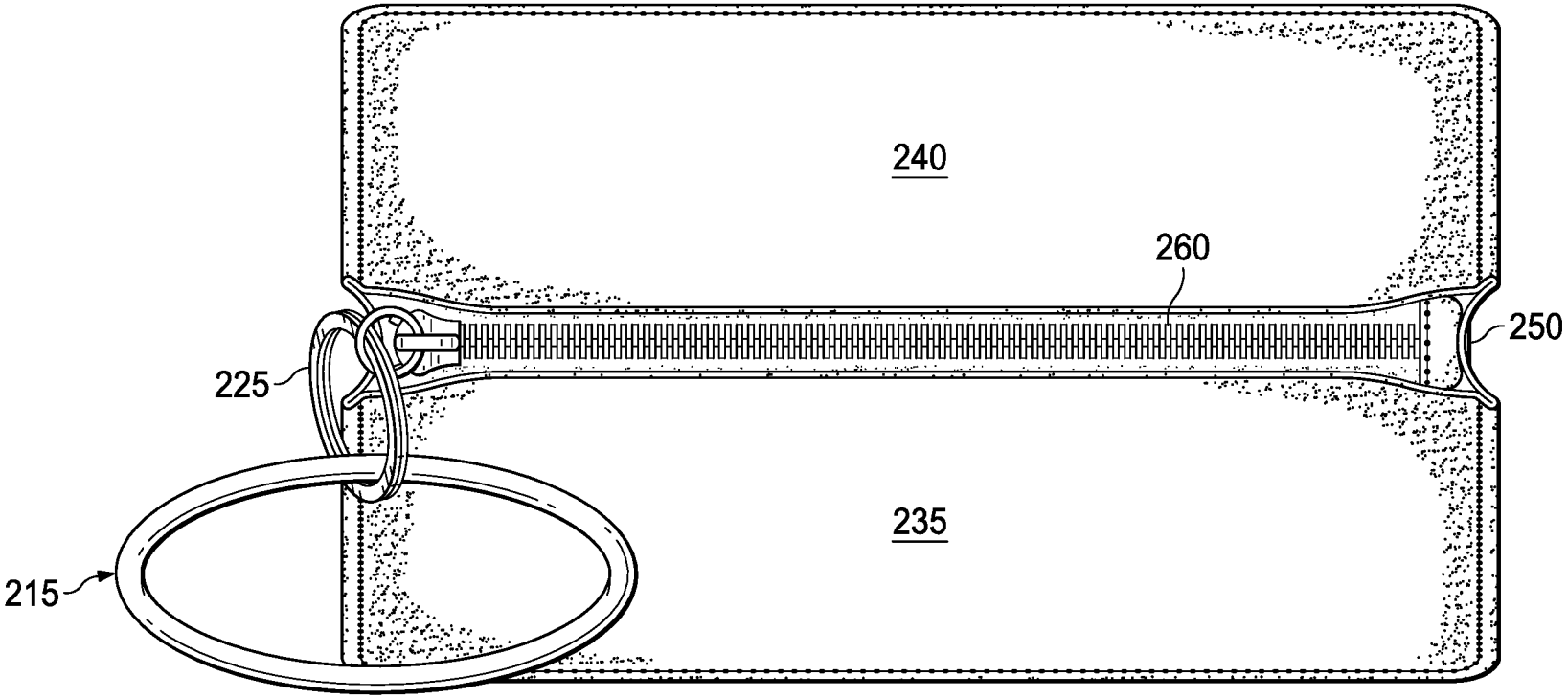
FIG. 24 is a top plan view of the personal item management apparatus of FIG. 19, according to one or more embodiments.

In several embodiments, as in FIG. 23, the end panel 245 puckers (e.g., inwardly or outwardly); this puckering of the end panel 245 allows the interior region 251 of the apparatus 210 to be expanded or collapsed proximate the end panel 245. As shown in FIG. 22, in several embodiments, the end panel 250 is identical or nearly identical to the end panel 245 and therefore will not be described in further detail.

As shown in FIGS. 25 and 26, the bottom panel 255 is generally rectangular in shape and is coupled at each of its sides, via the stitching 265, to one of: the side panel 235, the end panel 245, the end panel 250, and the side panel 240. In several embodiments, as in FIGS. 22 and 23, the bottom panel 255 puckers (e.g., inwardly or outwardly); this puckering of the bottom panel 255 allows the interior region 251 of the apparatus 210 to be expanded or collapsed proximate the bottom panel 255.

Figure 27:
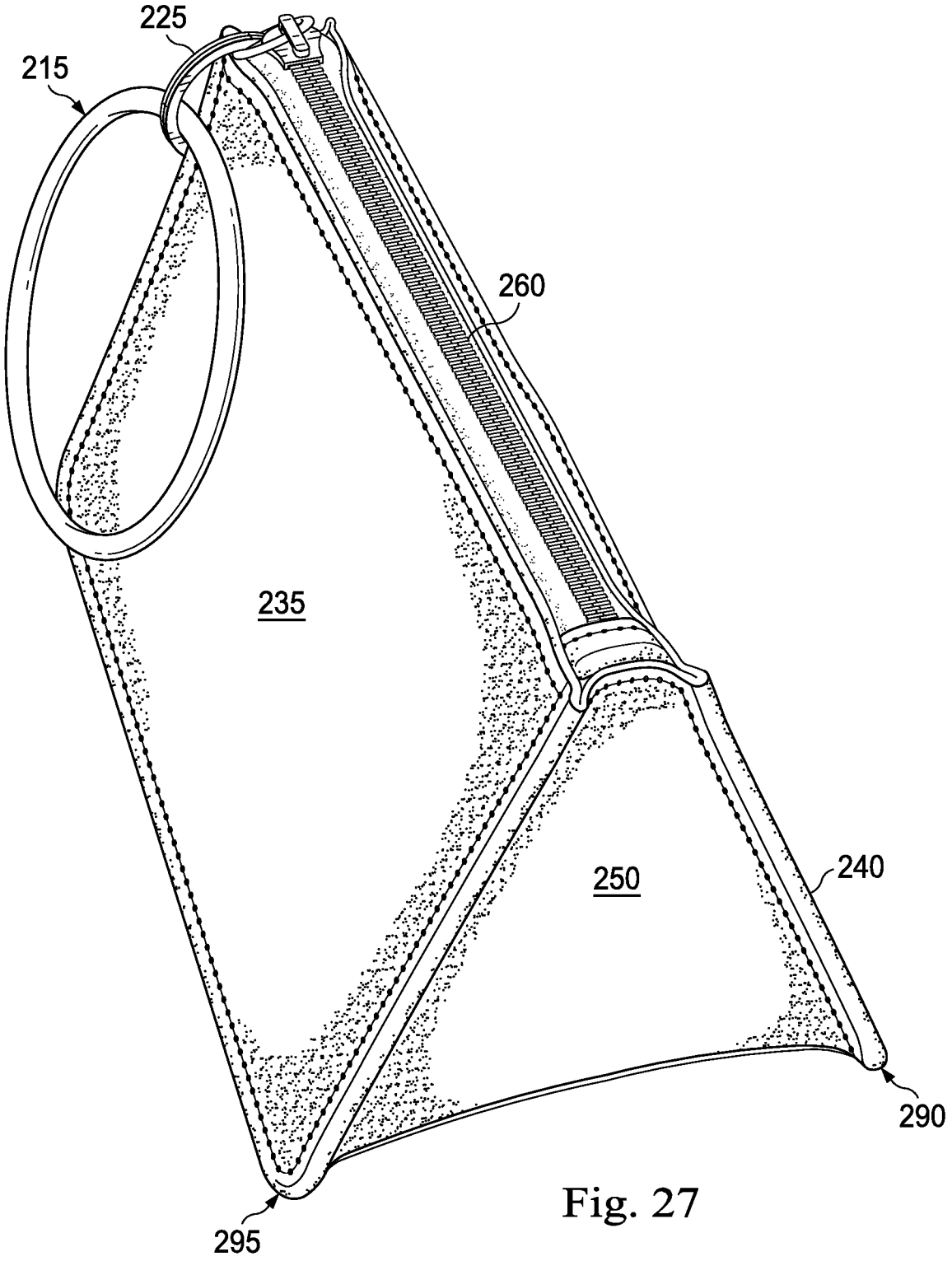
FIG. 27 is yet another perspective view of the personal item management apparatus of FIG. 19, according to one or more embodiments.

As shown in FIGS. 19, 26, and 27, each of the end panels 245 and 250 is (externally) concave relative to the stitching 265 that couples each of the end panels 245 and 250 to the side panels 235 and 240. The bottom panel 255 is also (externally) concave relative to the stitching 265 that couples the bottom panel 255 to each of the side panels 235 and 240 and/or to each of the end panels 245 and 250. As such, edges of the side panels 235 and 240, the end panels 245 and 250, and the bottom panel 255, that extend beyond the stitching 265 form, at least in part, feet 290 and 295 that are configured to contact a flat surface 300 (shown in FIGS. 22 and 23) upon which the apparatus 210 rests. In several embodiments, the seam allowances 280 where the bottom panel 255 and the side panel 235 are coupled together form the foot 290, and the seam allowances 280 where the bottom panel 255 and the side panel 240 are coupled together form the foot 295.

As shown in FIGS. 22 and 23, when resting on the flat surface 300, the majority of the bottom panel 255 is spaced apart from the flat surface 300. As a result, the feet 290 and 295 provide support for the apparatus 210. The feet 290 and 295 each have a height 290*a*. In several embodiments, the height 290*a* is about 0.3 cm; however, the height 290*a* may be anywhere between about 0.1 cm and about 1.0 cm. As such, the apparatus 210 is configured to stand upright upon the flat surface 300 using the feet 290 and 295. Moreover, as described, the apparatus 210 is sized to remain stable when supported upright on the feet 290 and 295. Since the majority of the bottom panel 255 is spaced apart from the flat surface 300, the cleanliness of the bag 220 is preserved.

As shown in FIGS. 19-23 and 27, the zipper 260 is coupled to the side panels 235 and 240 to enable a user to easily access the interior region 251 of the bag 220. In an embodiment, the clasp 225 may be or include one or more key rings or other similar couplers. In several embodiments, the clasp 225 (or a portion thereof) has an outer diameter of about 3 cm and an inner diameter of about 2.5 cm; however, the outer diameter may be between about 5 cm and about 2 cm and the inner diameter may be between about 4.5 cm and about 1.5 cm. Regardless of size, the clasp 225 couples the zipper 260 to the wearable band 215 such that, when the band 215 is hanging from the clasp 225, a top of the band

215 is between about 1 cm and about 2 cm from the zipper 260. As a result, when the band 215 is hanging from the clasp 225, the opening 215*e* extends over a midpoint of the height of the bag 220. In an embodiment, the clasp 225 is a self-locking clasp instead of a traditional split-ring key ring.

The apparatus 210 may be slid over the wrist of a wearer, or user. Generally, the band 215 is somewhat larger than the wrist of the wearer such that the band 215 may be comfortably disposed on the wrist like a bracelet. From the foregoing, it should be recognized that the apparatus 210 gives individuals a comfortable, hands-free way to stay organized and carry desired items on their wrists. Moreover, the apparatus 210 is self-standing to prevent the bag 220 from falling over and spilling items that are stored in the bag 220 and/or rearranging items that are stored in the bag 220. Moreover, the apparatus 210 provides a wearable band 215 that retains its shape (e.g., circular) to enable a user to easily insert his or her hand into the opening 215*e* of the band.

Attached hereto is an Appendix that includes Figures A through I. Specifically, in several embodiments, one or more of the embodiments of the present application are provided in whole or in part as described and illustrated in the Appendix, which forms part of the present application. Moreover, Figures A through I provide additional support for any U.S. or non-U.S. design applications that are to be filed in the future claiming priority to this present U.S. utility patent application. Figures A through I are similar to FIGS. 10-18, respectively, but Figures A through I do not include the reference numerals shown in FIGS. 10-18. More particularly, in the Appendix:

Figure A is a perspective view of a new, original design for a handbag;

Figure B is a front elevational view thereof;

Figure C is a rear elevational view thereof;

Figure D is a right side elevational view thereof;

Figure E is a left side elevational view thereof;

Figure F is a top plan view thereof;

Figure G is a bottom plan view thereof;

Figure H is another perspective view thereof; and

Figure I is yet another perspective view thereof.

In several embodiments, one or more of the embodiments described and illustrated in the Appendix are combined in whole or in part with one or more of the embodiments described above, illustrated in one or more of FIGS. 1 through 27, one or more other embodiments described and illustrated in the Appendix, or any combination thereof.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the embodiments disclosed above and in the Appendix, or variations thereof, may be combined in whole or in part with any one or more of the other embodiments described above and in the Appendix, or variations thereof.

Although several embodiments have been described in detail above and in the Appendix, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. An apparatus, comprising:

a bag, comprising:

opposing first and second side panels;

a zipper coupled to each of the opposing first and second side panels; and a hem coupled to the zipper and to each of the opposing first and second side panels;

and a wearable band adapted to be worn around a user's hand, wrist, or arm and coupled to the zipper so that the zipper is openable and closeable by moving:

the wearable band relative to the bag; and/or the bag relative to the wearable band;

wherein the first side panel defines a first edge along which the zipper is directly coupled to the first side panel via first stitching;

wherein a first seam allowance is defined between the first stitching and the first edge;

wherein the second side panel defines a second edge along which the zipper is directly coupled to the second side panel via second stitching, wherein a second seam allowance is defined between the second stitching and the second edge;

wherein the first and second seam allowances are devoid of any additional stitching on the first panel and the second panel, respectively;

wherein the first and second panels define third and fourth edges, respectively;

wherein the third edge of the first panel is spaced from the first edge of the first panel;

wherein the spacing between the first and third edges of the first panel defines a first distance;

wherein the fourth edge of the second panel is spaced from the second edge of the second panel;

wherein the spacing between the second and fourth edges of the second panel defines a second distance, the second distance being equal to the first distance;

wherein an interior region is defined by at least the first panel and the second panel;

wherein the zipper comprises:

opposing first and second end portions that are spaced from each other, teeth extending between the opposing first and second end portions, the extension of the teeth defining a path along which the opposing first and second end portions are spaced; and a slider engaged with the teeth, wherein the slider is adapted to slide between the opposing first and second end portions and relative to the bag;

wherein the first end portion of the zipper is positioned adjacent the first edge of the first panel and the second edge of the second panel;

wherein at least a portion of the teeth are positioned at the first end portion of the zipper and are spaced from the third edge of the first panel by at least the first distance, which is defined by the spacing between the first and third edges of the first panel;

wherein the portion of the teeth positioned at the first end portion of the zipper are spaced from the fourth edge of the second panel by at least the second distance, which is equal to the first distance and is defined by the spacing between the second and fourth edges of the second panel;

wherein the first and second panels define fifth and sixth edges, respectively;

wherein the fifth edge of the first panel is perpendicular to the third edge of the first panel;

wherein the sixth edge of the second panel is perpendicular to the fourth edge of the second panel;

wherein each of the fifth and third edges of the first panel terminate at a first corner portion of the first panel;

wherein each of the sixth and fourth edges of the second panel terminate at a second corner portion of the second panel;

wherein each of the fifth and first edges of the first panel terminate at a third corner portion of the first panel;

wherein each of the sixth and second edges of the second panel terminate at a fourth corner portion of the second panel;

wherein the first end portion of the zipper is proximate the third corner portion of the first panel;

wherein the first end portion of the zipper is proximate the fourth corner portion of the second panel;

wherein a third distance is defined between the third edge of the first panel and at least a portion of the first end portion of the zipper;

wherein the third distance is greater than the first distance, which is defined by the spacing between the first and third edges of the first panel;

wherein a fourth distance is defined between the fourth edge of the second panel and the portion of the first end portion of the zipper;

wherein the fourth distance is greater than the second distance, which is defined by the spacing between the second and fourth edges of the second panel;

wherein a fifth distance is defined between the fifth edge of the first panel and the second end portion of the zipper, and partially along the path defined by the extension of the teeth between the opposing first and second end portions of the zipper;

wherein the fifth distance is greater than the spacing between the opposing first and second end portions of the zipper along the path defined by the extension of the teeth between the opposing first and second end portions of the zipper;

wherein a sixth distance is defined between the sixth edge of the second panel and the second end portion of the zipper, and partially along the path defined by the extension of the teeth between the opposing first and second end portions of the zipper;

wherein the sixth distance is greater than the spacing between the opposing first and second end portions of the zipper along the path defined by the extension of the teeth between the opposing first and second end portions of the zipper;

wherein the zipper has a fully closed configuration in which:

the slider is located at the first end portion of the zipper;

at least a portion of the slider is spaced from the third edge of the first panel by at least the first distance;

the portion of the slider is spaced from the fourth edge of the second panel by at least the second distance;

the slider is proximate the third corner portion of the first panel; and the slider is proximate the fourth corner portion of the second panel;

wherein the zipper has a fully open configuration in which:

the slider is located at the second end portion of the zipper, which is opposite the first end portion of the zipper, and access to the interior region, which is defined by at least the first panel and the second panel, is permitted by said location of the slider;

wherein the hem is coupled to the zipper at the second end portion of the zipper;

wherein the hem is coupled to each of the opposing first and second side panels at the second end portion of the zipper;

wherein the hem defines a seventh edge to which the second end portion of the zipper is directly coupled to the hem via third stitching;

wherein a third seam allowance is defined between the third stitching and the seventh edge;

wherein the third seam allowance is devoid of any additional stitching on the hem;

wherein the wearable band is coupled to the zipper via at least first and second couplers;

wherein the first coupler is coupled to the slider of the zipper;

wherein the first coupler is coupled to the wearable band via at least the second coupler so that, as the slider of the zipper slides between the opposing first and second end portions of the zipper and relative to the bag, the wearable band, the second coupler, and the first coupler move with the slider and relative to the bag;

wherein the first coupler is rigid;

wherein the first coupler is located at the first end portion of the zipper when the zipper is in the fully closed configuration;

wherein the first coupler is located at the second end portion of the zipper when the zipper is in the fully open configuration;

wherein the second coupler is coupled to the zipper via at least the first coupler;

wherein the second coupler is coupled to the wearable band;

wherein the wearable band extends through an opening defined by the second coupler in a manner that causes the second coupler to extend around at least a portion of the wearable band;

wherein the second coupler is rigid;

wherein the second coupler is circular;

wherein the circular second coupler has an inner diameter and an outer diameter;

wherein the wearable band is rigid;

wherein the wearable band is circular;

wherein the circular wearable band has an inner diameter and an outer diameter;

wherein the inner diameter of the circular wearable band is fixed;

wherein the outer diameter of the circular wearable band is fixed;

wherein the circular wearable band defines a circular cross section;

wherein the circular cross section of the circular wearable band defines an end of the inner diameter of the circular wearable band;

wherein the circular cross section of the circular wearable band defines an end of the outer diameter of the circular wearable band;

wherein the circular cross section of the circular wearable band defines a cross-sectional diameter;

wherein the cross-sectional diameter defined by the circular cross section of the circular wearable band is equal to a difference between the outer diameter of the circular wearable band and the inner diameter of the circular wearable band;

wherein the circular cross section of the circular wearable band has a fixed circumference;

wherein the cross-sectional diameter defined by the circular cross section of the circular wearable band—which is equal to the difference between the outer diameter of the circular wearable band and the inner diameter of the circular wearable band—is constant and the same at any point along the fixed circumference of the circular cross section of the circular wearable band;

wherein the circular wearable band has a fixed circumference; and wherein the circular wearable band is continuous and uninterrupted along the fixed circumference thereof and thus:

the inner diameter of the circular wearable band is constant and the same along the fixed circumference of the circular wearable band; and the outer diameter of the circular wearable band is constant and the same along the fixed circumference of the circular wearable band.

* * * * *